United States Patent [19]

Pascal et al.

[11] Patent Number: 4,684,147

[45] Date of Patent: Aug. 4, 1987

[54] SKI BINDING

[75] Inventors: Roger Pascal, Annecy-le-Vieux; Pierre Rullier, Annecy, both of France

[73] Assignee: Salomon S.A., Annecy, France

[21] Appl. No.: 595,299

[22] Filed: Mar. 30, 1984

[30] Foreign Application Priority Data

Mar. 31, 1983 [FR] France ..... 83 05309

[51] Int. Cl.[4] ..... A63C 9/085

[52] U.S. Cl. ..... 280/628; 280/634

[58] Field of Search ..... 280/611, 628, 626, 620, 280/618, 629, 630, 631, 632, 634

[56] References Cited

U.S. PATENT DOCUMENTS

| | | | |
|---|---|---|---|
| 3,350,110 | 10/1967 | Salomon | 280/634 |
| 3,794,339 | 2/1974 | Smolka | 280/612 |
| 3,826,509 | 7/1974 | Smolka | 280/612 |
| 3,897,075 | 7/1975 | Cutter | 280/630 |
| 3,947,051 | 3/1976 | Sittman | 280/612 |
| 4,129,245 | 12/1978 | Bonvallet | 280/628 |
| 4,170,372 | 10/1979 | Salomon | 280/628 |
| 4,337,965 | 7/1982 | Salomon | 280/628 |
| 4,398,747 | 8/1983 | Bernard | 280/630 |
| 4,401,317 | 8/1983 | Horiuchi | 280/628 |
| 4,405,153 | 9/1983 | Salomon | 280/634 |
| 4,516,792 | 5/1985 | Scheck et al. | 280/634 |
| 4,589,673 | 5/1986 | Dimier et al. | 280/630 |

FOREIGN PATENT DOCUMENTS

| | | | |
|---|---|---|---|
| 1934060 | 1/1971 | Fed. Rep. of Germany | 280/628 |
| 1578974 | 5/1972 | Fed. Rep. of Germany | 280/628 |
| 3017841 | 11/1981 | Fed. Rep. of Germany | 280/630 |
| 2334382 | 7/1977 | France | 280/628 |
| 2375880 | 7/1978 | France | 280/631 |
| 2395046 | 2/1979 | France | 280/630 |
| 2418657 | 9/1979 | France | 280/612 |
| 2419737 | 10/1979 | France | 280/628 |
| 2420359 | 10/1979 | France | 280/634 |
| 2458299 | 1/1981 | France | 280/628 |
| 2478476 | 9/1981 | France | 280/634 |
| 483266 | 2/1970 | Switzerland | 280/634 |

*Primary Examiner*—John J. Love
*Assistant Examiner*—Eric D. Culbreth
*Attorney, Agent, or Firm*—Sandler & Greenblum

[57] ABSTRACT

A safety binding for releasably holding a boot to a ski which increases its release threshold in the event of a shock. The binding includes a maintenance element for releasably holding a boot on a ski, a device for biasing the maintenance element against release of the boot, and a non-electronic device for selectively increasing the bias of the maintenance element against release of the boot in response to a shock to the leg. The non-electronic device includes an auxiliary mechanical abutment attached to the ski. The abutment includes an inertial control device adapted to move from a rest position to an operating position in response to a shock. In the rest position, the auxiliary mechanical abutment has no effect on the release threshold of the maintenance element. In the operating position, the inertial control device biases the abutment against rotation. Because the abutment is connected to the maintenance element by a linkage element, the release threshold of the maintenance element is increased in the event of a shock.

116 Claims, 42 Drawing Figures

II
3
11
17
17b
17c
17a
14
15
12
13
16
18
19
12b
12c
27
23
21
22b
22
9
9a
5a
5
12a
8
7
6
4
25
24
9b
26
22a
2
3
A
1 x'
x
12e
14
11
15
12
13
12d
12a
27
23b
23
23a
22b
22
22a
8
6
7
9
26
4
5a
5
A
2
3

12
14
15
16
17a
13
17
18
19
17b
12b
17c
27
12a
23
F2
12e
12d
23b
23a
6
9
4
26
5a
5
22a
7
A
x1
x2
3
2

SKI BINDING

BACKGROUND OF THE INVENTION

1. Field of the Invention

The present invention relates to a ski binding.

2. Description of Prior Art

Ski bindings have been developed which automatically release the boot of a skier when excessive forces are exterted on the leg, which are strong enough to cause serious lesions to the leg. Generally, the release of this type of binding is accomplished mechanically against the bias of one or more springs which bias the binding against release of the boot. The boot is released when the force exerted on the leg is greater than the bias of the springs. This bias of the springs is adjustable by the skier.

Because the release depends only upon the value of the bias of the springs, these bindings have serious shortcomings. These shortcomings arise because serious lesions to the leg are a function of both the magnitude of the force and the duration of the force. Thus, the leg may be injured by a force below the threshold of the springs which has a long duration because these bindings do not take the duration of the force exerted on the leg into account. Furthermore, the leg of a skier can sustain a violent force if the force is sufficiently brief in duration. The value of the force the leg of a skier can withstand decreases as a function of the time during which this force is applied. This function is substantially hyperbolic.

In order to take into account the duration of the force as well as the magnitude of the force, bindings having electric release circuits have been developed. These bindings generally comprise a maintenance element for the boot which is controlled by an electromagnet. The electromagnet is connected to an electronic circuit having force constraint gauges. The gauges sense various forces acting on the leg and send this input to the electronic circuits.

Although bindings using an electric release circuit offer the advantage of being able to take into account the duration of the force discussed above, they also suffer from certain disadvantages. First, the forces acting on the leg cannot be detected in a reliable manner. Although force gauges may accurately detect forces on one or more test bodies under laboratory test conditions, and consequently produce good results in the laboratory, the force gauges do not function properly during skiing. This occurs because the force gauges can become loose or disengage from the binding due to bad adhesion, or as a result of shocks, or as a result of the influence of low temperatures. Second, the electric circuits needed for these bindings must constantly be maintained under voltage. This requires the use of electric power batteries, which quickly run down. This is a serious disadvantage. Furthermore, because the release is susceptible to such problems as the rapidity of response, aging, and reliability, the electric circuits are also adversely affected. Finally, the use of electronic releases alone is not normally acceptable to skiers for two additional reasons. In electronic releases there is a direct transmission of the shocks to the leg of the skier, which is uncomfortable and there is the danger of a possible malfunction.

SUMMARY OF THE INVENTION

The present invention overcomes the various disadvantages previously recited by providing a safety binding whose design is particularly simple and which is purely mechanical, while nevertheless having the inherent advantages of electronic circuit release bindings.

The safety binding for use with skies and ski boots of the present invention comprises a maintenance element for a ski boot. The maintenance element is biased into a rest position, in which the longitudinal axis of the maintenance element is substantially parallel to the longitudinal axis of the ski, by an elastic energization mechanism. The elastic energization mechanism defines an adjustable release threshold. The release threshold is defined as the value of the force exerted by the boot on the maintenance element above which the boot is liberated.

The binding further comprises an auxiliary mechanical abutment attached to the ski. This auxiliary mechanical abutment is defined as a non-electronic mechanism, for selectively increasing the release threshold of the maintenance element (or for selectively increasing the bias of the maintenance element against release of the boot). The abutment cooperates with an element which controls the release threshold of the binding. The abutment comprises inertial control means. The inertial control means is defined as a non-electronic means for actuating the auxiliary mechanical abutment to increase the release threshold of the maintenance element.

The inertial control means can assume two positions. The first position is a rest position in which, during normal conditions (e.g., when no shock is incident upon the binding), the abutment exerts no influence on the release threshold of the binding. The second position is an operating position. The inertial control means moves from the rest position to this operating position in response to an intense and brief force or shock. A shock is defined as a force of sufficient magnitude, that if it is exerted on the leg for a sufficient duration, it would injure the leg, but by virtue of its sufficiently short duration it does not injure a leg held in a binding on a ski. In the operating position there is a linkage between the maintenance element and the auxiliary mechanical abutment. This linkage causes, in turn, an increase in the release threshold, called a "hardening" of the binding.

The invention may be used with a safety binding comprising a maintenance element integral with a body which forms a unit pivotally mounted on a support attached to the ski. In this embodiment the element controlling the release threshold value is integral with the pivoting unit.

The invention can also be used with a binding in which the maintenance element comprises two independent, lateral retention wings journalled around their respective axes and biased into a rest position by a rod biased by a principal spring. In this embodiment, the element controlling the release threshold value of the binding intervenes when the inertial control means moves into its operating position, to add to the force exerted by the principal spring, a force generated by an auxiliary spring.

According to a first embodiment of the invention, the auxiliary mechanical abutment is coupled to an intermediate linkage element which modifies the release conditions and the release threshold of the binding when the inertial control means moves into the operating position as a result of a shock.

According to an alternative embodiment, the auxiliary abutment is coupled to an intermediate linkage element which varies the tension of the elastic energization mechanism, in the form of a spring, when the inertial control means moves into the operating position as a result of a shock.

According to another embodiment of the invention, the auxiliary mechanical abutment is coupled to an intermediate linkage element which acts as an additional spring whose force is added to that of the elastic energization mechanism spring to increase the value of the release threshold when the inertial control means moves into the operating position as a result of a shock.

According to yet another embodiment of the invention, the inertial control means is adapted to couple the intermediate linkage element (which is integral with the pivotable unit), and the auxiliary mechanical abutment. In addition, the auxiliary mechanical abutment is itself biased against movement by an additional energization mechanism.

The safety binding of the present invention makes it possible to obtain, by purely mechanical means, two types of responses depending upon the nature of the forces applied. A relatively low release threshold is provided under normal skiing conditions, i.e., as long as there is no brief, intense force or shock exerted on the ski. On the other hand, a very high release threshold is provided as soon as a shock is applied to the ski. As a result, the safety binding is "hardened" in the case of a shock of brief duration. Thus, the binding does not give an undesired and early release in this event. This is advantageous because, as was previously noted, the leg of a skier can be subjected to a violent force for a brief duration without injury.

Another embodiment of the invention comprises a safety binding for holding a boot on a ski and releasing the boot in response to an external force applied to the binding. The binding comprises a maintenance element for releasably holding the boot on the ski, a means for biasing the maintenance element against release of the boot, and a non-electronic means for selectively increasing the bias of the maintenance element against the release of the boot as a function of the duration of the force. The bias increasing means increases the bias of the maintenance element against the release of the boot in response to a shock to the leg. In another embodiment, the bias increasing means increases the bias of the maintenance element only in response to a shock.

The maintenance element is adapted to be displaced to release the boot, and the bias increasing means is adapted to move from a rest position to an operating position in response to a shock. In the rest position, the bias increasing means permits substantially free displacement of the maintenance element when the force is greater than the bias of the bias means. In the operating position, the bias increasing means prevents displacement of the maintenance element when the force comprises a shock.

The bias increasing means comprises an auxiliary mechanical abutment, attached to the ski. This abutment, in turn, comprises an inertial control means or mechanism for controlling the abutment. The inertial control means or mechanism is adapted to move from a rest position to an operating position in response to a shock. In the rest position, the abutment permits substantially free displacement of the maintenance element as discussed above. In the operating position, the abutment increases the bias of the maintenance element against release of the boot. The binding further includes a linkage means linking the abutment with the maintenance element when the inertial control means is in the operating position.

In addition, the bias means comprises, in one embodiment, an elastic mechanism or spring. The linkage means varies the tension of the elastic mechanism when the inertial control means is in its operating position.

The abutment further comprises a locking means connected to the linkage means when the inertial control means is in its operating position. The locking means is biased against displacement when the inertial control means is in its operating position.

The abutment further comprises a base supporting the inertial control means and the locking means. The locking means is selectively rotatably mounted on the base. The locking means rotates substantially freely when the inertial control means is in its rest position and is biased against rotation when the inertial control means is in its operating position.

The abutment further comprises a cover, covering the base and the inertial control means. The cover comprises a circular capsule having two diametrically opposed protuberances, each having a vertical opening therein. The base further includes two openings and the binding further includes binding screws each of which is adapted to engage one of the openings in the protuberance and one of the openings in the base to attach the cover to the base.

The inertial control means further comprises a ball bearing adapted to engage a spherical seat on the base. In addition, the inertial control means includes a locking lever journalled around a transverse axis. The locking lever comprises an anterior arm adapted to be supported on the ball bearing, and a posterior arm biased out of contact from the locking means when the inertial control means is in the rest position. The posterior arm has a portion adapted to contact a portion of the locking means to bias the locking means against rotation to define an operating position of the inertial control means. In one embodiment, the portion of the posterior arm that is adapted to contact the locking means has at least one notch, and the portion on the locking means adapted to contact the posterior arm has at least one tooth. Alternatively, the portion on the arm may have at least one tooth and the portion on the locking means may have at least one notch thereon.

The inertial control means further comprises a transverse axis pin around which the lever is adapted to pivot, and a return spring for biasing the lever out of contact with the locking means. The base further comprises two longitudinal and vertical wings between which the lever is positioned. Each wing includes an opening adapted to receive the transverse axis pin. In addition, the lower portion of the posterior arm comprises a recess adapted to receive an upper end of the return spring. Also, the lever further comprises a reinforcement at the lower portion thereof, and having a transverse opening therein for receiving the transverse axis pin. The base further includes an opening therein, and the abutment further comprises attachment screws adapted to pass through these openings to attach the base to the ski.

The locking means comprises a cylindrical skirt radially extending toward the exterior of the locking means. Forked extensions extend from the skirt toward the rear of the binding in which the linkage means is adapted to engage. Anterior and posterior collars extending from the skirt toward the interior of the locking means are also provided on opposite sides of the skirt. The upper portion of the posterior collar is the portion of the locking means that is adapted to contact the lever. In addition, the bottom portions of both collars are adapted to be supported on the base. In addition, the collars are substantially in the same transverse plane, are substantially arc-shaped, and are disposed symmetrically with respect to the longitudinal axis of the binding when the locking mechanism is in its rest position. In addition, the posterior collar comprises at least one notch on the upper surface thereof adapted to contact a tooth on the lever when the lever is in its operating position. Alternatively, the posterior portion of the collar can comprise a tooth adapted to contact a notch on the lever when the inertial control mechanism is in its operating position.

In addition, the binding further includes a support, attached to the ski and a body, integral with the maintenance element so as to form an assembly therewith, pivotable around the support to release the boot. Also included is a means for controlling the bias against release of the boot which is connected to the linkage means. This control means is part of the pivotable assembly. Also, the bias means may comprise an elastic mechanism or spring.

In one embodiment, the support has an anterior surface and the elastic means comprises a spring and a piston. The spring biases the piston toward the anterior surface of the support and the linkage means comprises a plate positioned between the anterior surface of the support and the piston.

The abutment further comprises a base and the locking means is rotatably mounted on the base around a substantially vertical axis. The locking means is biased against rotation by the inertial control means when the inertial control means is in its operating position.

The elastic mechanism further comprises an adjustment means for adjusting the bias of the spring. This adjustment means may be in the form of an adjustment cap positioned at the end of the spring that is opposite from the end of the spring in contact with the plate. The piston may include a protuberance thereon adapted to engage an opening in the plate. The protuberance is positioned symmetrically with respect to the vertical and longitudinal plane of symmetry of the binding. The protuberance may have a substantially trapezoidal configuration in horizontal cross-section, and the opening may be substantially in the shape of an isosceles trapezoid.

The protuberance comprises a V-shaped front surface, two lateral surfaces bordering on either side of the front surface, and inclined from the exterior to the interior of the piston in the direction of the support; two upper surfaces inclined from the top to the bottom and toward the exterior of the piston, positioned symmetrically with respect to the vertical and longitudinal plane of symmetry of the binding; and two lower surfaces positioned symmetrically with respect to the vertical and longitudinal plane of symmetry of the binding and inclined from the bottom to the top of the piston, toward the exterior of the piston.

In addition, the plate may comprise a substantially vertical arm of the linkage means having an opening therein. The opening is defined by two lateral planar surfaces symmetrical with respect to the vertical and longitudinal plane of symmetry of the binding, and having substantially the same inclination as the lateral surfaces of the protuberance, and converging toward the support. Two upper surfaces are also provided, which are inclined from the top to the bottom of the plate toward the exterior thereof. Also, two lower surfaces are provided, inclined from the top to the bottom of the plate toward the exterior. The opening has uncurved or linear cross-section opposite from the support, substantially in the shape of an isosceles trapezoid having two bases, one smaller than the other. The smaller base is directed downwardly. The larger base has a uncurved cross-section comprising two inclined sides each of which are part of a different symmetrical right trapezium. In this way, the opening is adapted to permit the angular displacement of the protuberance with respect to the opening during pivoting of the assembly.

The vertical arm also has a posterior surface having two strips thereon which together have a V-shaped configuration. These strips are adapted to contact the anterior surface of the support.

The plate comprises a substantially vertical arm of the linkage means. The linkage means further comprises a substantially horizontal arm having a posterior end journalled on an anterior end of the substantially vertical arm. The anterior end is adapted to be engaged in the abutment. In addition, the linkage means further comprises a transverse axis pin. The substantially horizontal arm is journalled around the transverse axis pin. The substantially horizontal arm further comprises a nipple, extending upwardly from its anterior end, which is adapted to be engaged in the abutment. The posterior end of the horizontal arm has a notch therein. This notch defines two lateral wings at each transverse end thereof. Each wing has an opening therein adapted to receive the transverse axis pin. The lateral wings form a cap for the axis pin.

In another embodiment, the binding further comprises a support on the ski, and a body integral with the maintenance element to form an assembly pivotable about the support. In this embodiment, the bias means is an elastic means or spring that is part of the assembly. In addition, the linkage means increases the tension of the bias means when the inertial control means is in its operating position. The assembly in this embodiment, further comprises an adjustment cap for adjusting the tension of the elastic means. The cap has an opening therein and comprises an auxiliary piston also adapted to slidingly be mounted therein. The linkage means further comprises a shaft having a posterior end engaging the locking means and an anterior end having a substantially hemispherically shaped head integral therewith. The head is adapted to be engage the adjustment cap. In addition, the shaft passes through the opening in the adjustment cap. Also, the auxiliary piston is biased against a diametral surface of the hemispherically shaped head by the elastic means.

In another embodiment, an additional bias means is provided which is coupled to the linkage means. The bias of the additional bias means is added to the bias of the bias means to bias the maintenance element against the release of the boot when the inertial control means is in its operating position. In this embodiment, the bias means comprises a first elastic mechanism and the additional bias means comprises a second elastic mechanism. In addition, the assembly further comprises an adjustment cap for adjusting the tension of the first elastic mechanism. The adjustment cap comprises a transverse wall and a bottom portion which together define a chamber. In addition, the adjustment cap further comprises a substantially hemispherically shaped seat adjacent to an opening therein. In addition, the second elastic mechanism and an auxiliary piston are provided in this chamber in the adjustment cap. Also, the linkage means further comprises a shaft having a posterior end engaged in a locking means, and an anterior end having a substantially hemispherically shaped head integral therewith and rotatingly mounted in the seat of the adjustment cap. The shaft extends through the opening and the second elastic mechanism biases the auxiliary piston against a diametral surface of the head.

In another embodiment of the invention, the abutment is unattached to the linkage means when the inertial control means is in its rest position. In addition, the linkage means is attached to the maintenance element when a portion of the inertial control means contacts the linkage element when the inertial control means is in its operating position. In addition, the bias increasing means biases the abutment against movement with the maintenance element when the inertial control means is in the operating position.

In addition, the binding further comprises a support, attached to the ski, and a body integral with the maintenance element to form a pivotable assembly pivotable about the support against the bias of the bias means. In this embodiment, the bias means is part of the pivotable assembly. In addition, the linkage means is attached to the assembly and the abutment is adapted to be pivoted. Also, the bias increasing means biases the abutment against pivoting with the assembly when the inertial control means is in its operating position.

In this embodiment, the linkage means comprises an arm attached to the body of the binding. In addition, the abutment further comprises a bose attached to the ski, and a disk rotatably mounted on the base having a seat thereon. In addition, the inertial control means comprises a bass bearing supported by the seat, and a lever journalled about a transverse axis. The lever has an anterior arm biased into contact with the ball bearing when the inertial control means is in its rest position. The lever also has a posterior arm, spaced from the arm of the linkage means when the inertial control means is in its rest position. In addition, the lever pivots so that the posterior arm contacts the arm of the linkage means when the inertial control means is in its operating position. In this embodiment, the disk is substantially horizontal and is adapted to pivot around a substantially vertical axis. In addition, the disk has an upper surface in which the seat is disposed.

The abutment further comprises a spring, disposed between the lever and the disk for biasing the anterior arm against the ball bearing when the inertial control means is in its rest position. The lever also has a transverse opening therein and the disk further comprises a platform having a transverse opening therein. A transverse axis pin is adapted to engage the transverse opening in the lever and the platform.

The arm of the linkage means has an end comprising a notch. The posterior arm comprises at least one tooth adapted to engage this notch when the inertial control means is in its operating position. Alternatively, the arm of the linkage means can comprise a tooth and the posterior arm can comprise at least one notch adapted to engage this tooth when the inertial control means is in its operating position.

The disk further comprises a groove thereon and the bias increasing means further comprises a projection biased to engage the groove when the inertial control means is in its rest position. The groove is positioned in the longitudinal plane of symmetry in the binding when the inertial control means is in its rest position. Also, the notch is positioned on the opposite side of the disk from the linkage means. The disk further includes a substantially vertical peripherial rib having a notch therein. Also, the bias increasing means is attached to the ski and further comprises a spring adapted to bias the projection toward the notch.

In another embodiment, the maintenance element comprises two independent lateral retention wings, each of which is adapted to be journalled around a separate axis. the bias means biases the wings against journalling around these axes. In addition, the bias increasing means comprises an additional bias means for additionally biasing the wings against jornalling only when the inertial control means is in its operating position. The bias means comprises a rod contacting the wings, and a primary spring. The primary spring biases the rod against the wings so as to bias the wings against journalling. The bias increasing means comprises an element slidingly mounted on the ski, and a secondary spring attached between the rod and this sliding element. The inertial control means comprises a lever adapted to engage the sliding element to prevent sliding movement thereof when the inertial control means is in its operating position.

In one embodiment, the wings may be spaced apart. In addition, the rod may extend between the spaced apart wings. In this embodiment, the biasing means further comprises a head at the posterior end of the rod and a support on the rod. This support is spaced a sufficient distance from the head so that the head contacts one side of the wings and the support contacts the other side of the wings. The primary spring biases the support against the other side of the wings in the rest position. Also provided on the bias means is a plate, attached to the anterior end of the rod so that the secondary spring contacts this plate. The binding further comprises a base, extending from the wings to the sliding element. The sliding element is adapted to slide on the base. In addition, the inertial control means further comprises a support and a ball bearing on the support. The lever has a posterior end which is adapted to engage the sliding element when the inertial control means is in its operating position. The lever also has an anterior end, adapted to engage the ball bearing when the inertial control means is in its rest position. The lever is adapted to be spaced from the sliding element when the inertial control means is in its rest position.

In still another embodiment, the invention comprises a binding for holding a boot on a ski. The binding includes a maintenance element, an elastic mechanism and an auxiliary mechanical abutment. The maintenance element is adapted to realeasably hold the boot on the ski in a rest position. The elastic mechanism is adapted to bias the maintenance element into a rest position. The elastic mechanism defines a release threshold, above which the maintenance element releases the boot. The auxiliary mechanical abutment is adapted to be attached to the ski. The abutment comprises an inertial control mechanism adapted to occupy a rest position and an operating position. The abutment increases the release threshold of the maintenance element when the inertial control mechanism is in the operating position. In another embodiment the abutment increases the release threshold of the maintenance element only when the inertial control mechanism is in the operating position. All of the features and elements discussed above in connection with the other embodiments of the invention are included in this embodiment of the invention.

BRIEF DESCRIPTION OF THE DRAWINGS

The invention will now be described, by way of non-limiting example, with reference to the attached drawings, given by way of example only, in which.

DESCRIPTION OF THE PREFERRED EMBODIMENTS

Figure 1:
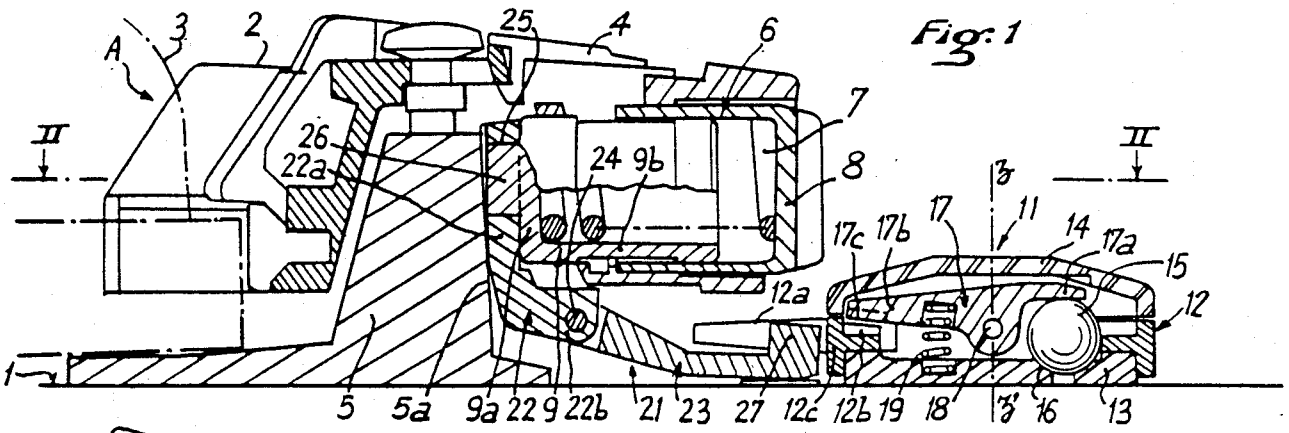
FIG. 1 is a vertical and longitudinal cross-sectional view of the safety binding of the present invention, provided with an auxiliary mechanical abutment in which the inertial control means is in the rest position.
Figure 2:
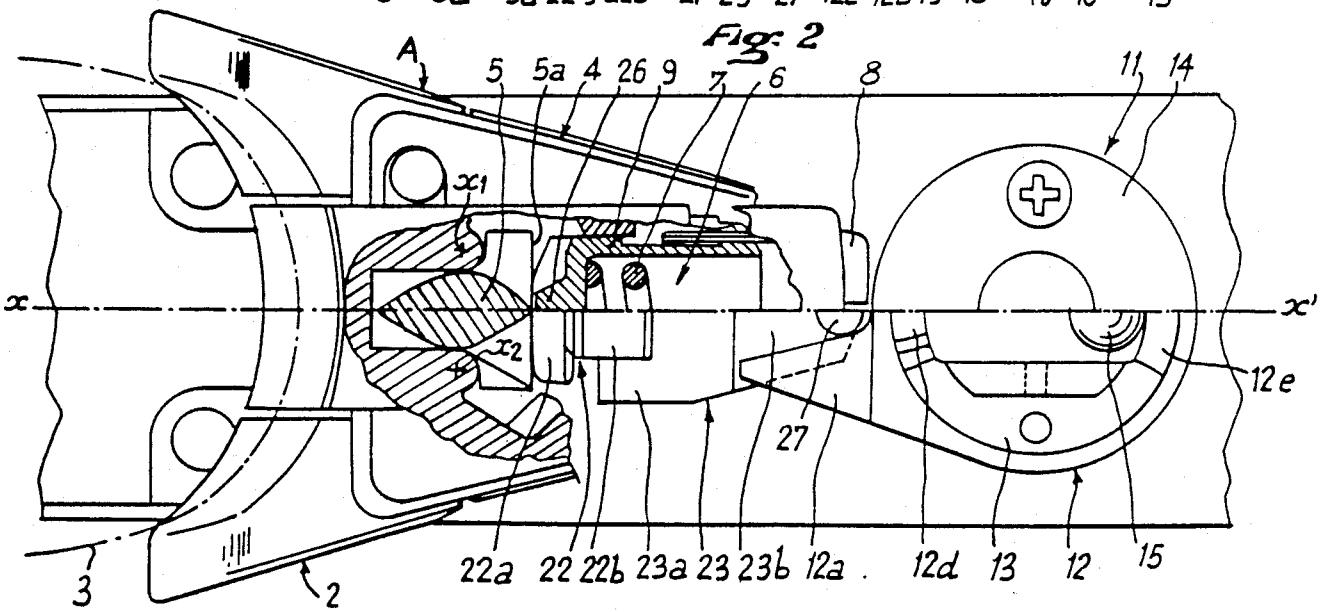
FIG. 2 is a planar view, partially in horizontal cross-sectional view along line II—II of FIG. 1, of the binding of the present invention.

FIGS. 1 and 2 illustrate a first embodiment of the safety binding of the present invention. Binding A comprises, in the non-limiting example illustrated in FIGS. 1 and 2, a front binding mounted on ski 1. This front abutment comprises a jaw or maintenance element 2 which is adapted to maintain and hold the front portion of a ski boot 3 (shown in dashed lines in the drawing) on ski 1. Jaw 2 is integral with a body 4 pivotably mounted on a support 5 attached to ski 1. Support 5 comprises a support element which supports the pivotable unit or assembly formed by jaw 2 and body 4. This unit or assembly is laterally pivotable on support element 5 around one of two lateral lines of support $x_1$, $x_2$ perpendicular to the ski or which converge, to assure the safety release of the boot as has already been described in Applicant's French Pat. Nos. 75 37908; 78 07805; 79 14484; 78 08342; and 80 06365, which are hereby incorporated by reference.

The pivotable assembly 2 and 4 is longitudinally biased towards support element 5 and against release of the boot by elastic energization mechanism 6 which comprises spring 7. The tension of this spring defines the adjustable release threshold of the maintenance element 2. When a force exerted on jaw 2 is greater than this release threshold assembly 2, 4 can laterally pivot on support element 5. The tension of this spring, which determines the release threshold, is adjustable, in a known manner, by means of a cap 8, screwed as desired, into body 4, in a threaded opening into the rear surface thereof. Spring 7 is supported, at its anterior end on the end of the adjustment cap 8. The posterior end of spring 7 acts on pressure element 9, comprising, for example, a hollow piston. Hollow piston 9 comprises a transverse end 9*a* and a cylindrical peripheral skirt 9*b* slidably engaged in a corresponding lateral skirt of cap 8.

The binding is also provided with a non-electronic means for selectively increasing the bias of the maintenance element 2 against release of the boot, as a function of the duration of a force applied to the binding. This bias increasing means can comprise an auxiliary mechanical abutment 11, associated with the safety binding. The abutment can modify the release conditions of the binding. More specifically, the abutment can vary the release threshold of the binding as a function of whether the leg of the skier is subjected to an intense force of short duration, having a rapidly increasing intensity, (in other words a "shock"), or a force exerted during a longer period of time, having a relatively slow increase in its intensity, hereinafter referred to as a "slow force". A "shock" is defined as a force of sufficient magnitude, that if it is exerted on the leg for a sufficient duration, it would injure the leg, but by virtue of its short duration it does not injure a leg held in a binding on a ski. (A slow force is also defined as a force that is not a shock.)

For example, forces having a magnitude of 150 daN and having a duration of 5 ms or having a magnitude of 50 daN and a duration of 30 ms are considered shocks. In addition, for example a force which increases in intensity from 0 to 150 daN over 2.5 ms and then decreases in intensity from 150 daN to 0 over 2.5 ms is considered a shock.

The bias increasing means (e.g. in this embodiment abutment 11) increases the release threshold and the bias of the maintenance element 2 against release of the boot (and against displacement) in response to a shock to the leg. Also, the bias increasing means (or abutment 11) increases the bias of maintenance element 2 against release of the boot and increases the bias of maintenance element 2 against lateral pivoting (and increases the release threshold) only in response to a shock.

Auxiliary mechanical abutment 11 is adapted to be attached on ski 1 in front of the safety binding. Abutment 11 comprises a locking mechanism 12 having a circular configuration, which can rotate around a substantially vertical axis zz'. Locking mechanism 12 comprises an extension 12*a* in the form of a fork which extends toward the rear. Locking mechanism 12 is substantially freely rotatably mounted on base or socket 13 attached to ski 1 and is adapted to be locked against rotation on base 13 as will be discussed below. Locking mechanism 12 is capped by a cover 14. An inertial control mechanism is positioned within the interior of the casing formed by cover 14 and base or socket 13. The inertial control means is defined as a non-electronic means for actuating the auxiliary mechanical abutment to increase the release threshold of the maintenance element.

The inertial control mechanism comprises a ball bearing 15 normally lodged or engaged in a substantially spherical seat 16 provided in the upper surface of base or socket 13 and which is centered in the longitudinal plane of symmetry xx' of binding A and of abutment 11. Seat 16 of bearing 15 is positioned in front of the vertical axis of rotation zz' of locking element 12.

The inertial control mechanism further comprises a lever 17 extending longitudinally and journalled on base 13 around horizontal and transverse axis pin 18 supported by base 13. Lever 17 comprises an anterior arm or branch 17a extending above bearing 15 and in contact with the apex thereof, and a posterior arm 17*b*. A compression spring 19 is interposed between posterior arm or branch 17*b* of lever 17 and the upper surface of base 13 to bias lever 17 in the clockwise direction of FIG. 1. Spring 19 is preferably positioned, at its two ends, in openings provided in lever 17 and in base 13. The ends of posterior arm 17*b* form a tooth 17*c* positioned above a notch 12*b* of locking mechanism 12. This notch 12*b* is preferably positioned within a cylindrical skirt 12*c* of locking mechanism 12. Alternatively, the ends of posterior arm 17*b* form a notch 17*c* positioned above a tooth 12*b*of locking mechanism 12.

The linkage between binding A and auxiliary mechanical abutment 11 is accomplished by an intermediate linkage element 21 which can comprise one piece or, preferably, can comprise two elements 22 and 23 journalled relative to one another around a horizontal and transverse axis pin 24. The posterior element 22 which is adjacent to support element 5 comprises a plate bent at a substantially right angle which is interposed between piston 9 and support element 5. Plate 22 comprises a substantially vertical arm 22*a* having an opening 25 therein. A protuberance 26 extending rearwardly from the end of piston 9, (i.e., in the direction of support element 5) engages opening 25. Plate 22 furthermore comprises a lower longitudinal arm 22*b* extending substantially horizontally frontwardly. Arm 22*b* is journalled around transverse axis pin 24. This axis pin 24 is supported between two lateral wings 23*a* forming a cap, of the anterior element 23. Anterior element 23 comprises an arm having, on its upper surface and at its anterior end, a stud or nipple 27 which is lodged between (or engages) two branches of fork 12*a* of locking mechanism 12.

FIGS. 3–27 illustrate in a detailed manner the various elements of auxiliary mechanical abutment 11 and of the elements connected to this abutment.

Figure 3:
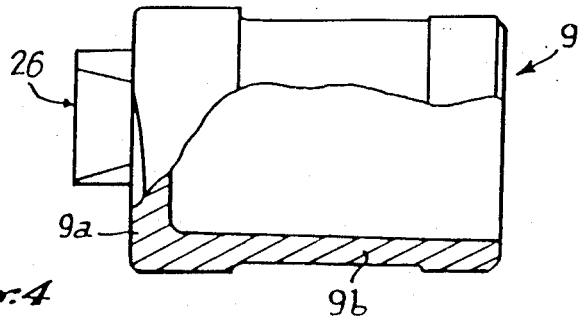
FIG. 3 is an elevational view, partially in vertical and longitudinal cross-section, of the piston of the elastic energization mechanism.
Figure 4:
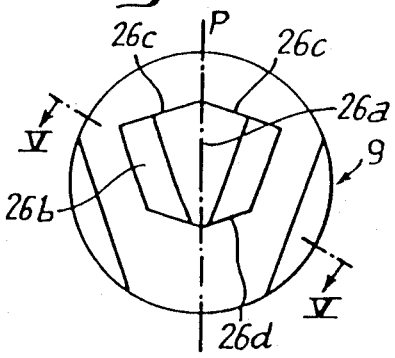
FIG. 4 is a profile view of the piston of FIG. 3, seen from the left of the figure.
Figure 5:
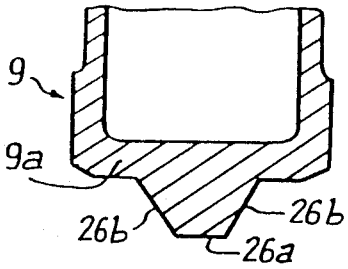
FIG. 5 is a cross-sectional view taken along line V—V of FIG. 4.

FIGS. 3–5 illustrate piston 9 having a substantially cylindrical shape, comprising a transverse end 9*a*, and a substantially cylindrical skirt 9*b* and an external protuberance 26 extending from transverse end 9*a*. Protuberance 26 which is symmetrical with respect to the vertical and longitudinal plane of symmetry P of the binding, comprises a front surface 26*a* having a substantially V-shaped configuration. Front surface 26*a* is bordered on each side by a lateral surface 26 *b* which is inclined from the exterior the interior of piston 9 in the direction of support element 5. As a result, protuberance 26 has, a trapezoidal configuration in horizontal cross-section, which be seen in FIG. 5. Protuberance 26 also comprises two upper surfaces 26*c* which are inclined from the top to the bottom of piston 9 towards the exterior and are symmetrical with respect to plane P. Protuberance 26 further comprises, at its lower portion, two surfaces 26*b* symmetrical with respect to vertical plane P and inclined from the bottom to the top of support 9 towards the exterior.

Piston 9 is adapted to cooperate with plate 22 which is illustrated in detail in FIGS. 6–10. Opening 25 is bored in substantially vertical arm 22*a* of plate 22. Protuberance 26 of piston 9 engages opening 25. The opening is defined by two surfaces symmetrical with respect to vertical plane P, i.e., two lateral surfaces 25*b*, having the same inclination as lateral surfaces 26*b* of protuberance 26 and converging in the direction of support element 5. Opening 25 is also defined by two upper surfaces 25*c* inclined from the top to the bottom of plate 22 towards the exterior and two lower surfaces 25*d* which are also inclined from the top to the bottom of plate 22 towards the exterior.

As a result of these inclined surfaces, opening 25 has an uncurved or linear cross-section, across from support element 5, substantially in the form of an isosceles trapezoid having its smaller base directed downwardly. On the opposite side from this smaller base, opening 25 has an uncurved or linear section which is significantly larger than the smaller base and which comprises the inclined sides of two symmetrical rectangular trapezium connected to one another by these inclined sides.

The configuration of opening 25 is adapted to allow for the angular displacement of protuberance 26 of piston 9 in this opening with respect to opening 25 and plate 22 during release as will be explained below.

The posterior surface of vertical arm 22*a* of plate 22 has two support strips 22*c* in a V-shaped configuration which extend from both sides of opening 25, and by means of which plate 22 is pressed against anterior surface 5*a* of support element 5.

Substantially horizontal arm 22*b* of plate 22 comprises two substantially horizontal lateral wings 22*d* which are coplaner. Beneath these wings arm 22*b* is bored on both sides with a transverse bore 22*e* which provides a passage for journal axis pin 24, assuring the linkage with arm 23.

Figure 9:
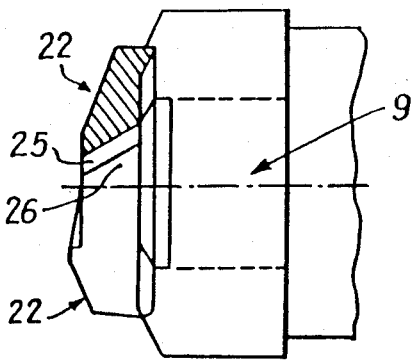
FIG. 9 is a planar view, partially in horizontal cross-section along line IX—IX of FIG. 8, of the plate and of the associated posterior portion of the piston.

FIG. 9 illustrates in a detailed manner the engagement of protuberance 26 of piston 9 in opening 25 of plate 22.

Figure 12:
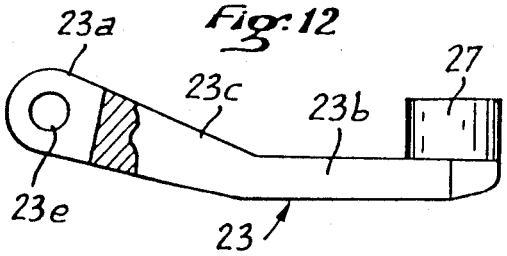
FIG. 12 is an elevational view, partially in vertical and longitudinal cross-section, of the linkage arm of FIG. 11.
Figure 13:
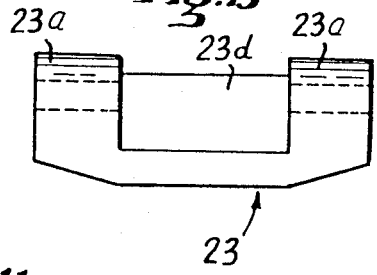
FIG. 13 is a profile view of the linkage arm, as seen from the left of FIG. 12.
Figure 11:
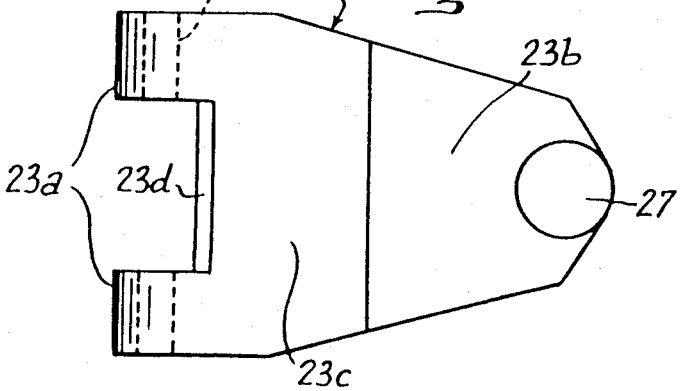
FIG. 11 is a planar view of the arm of the linkage with the auxiliary mechanical abutment.
Figure 6:
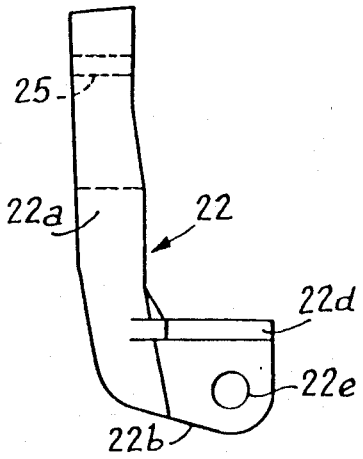
FIG. 6 is an elevational view of the plate of the intermediate linkage element.
Figure 7:
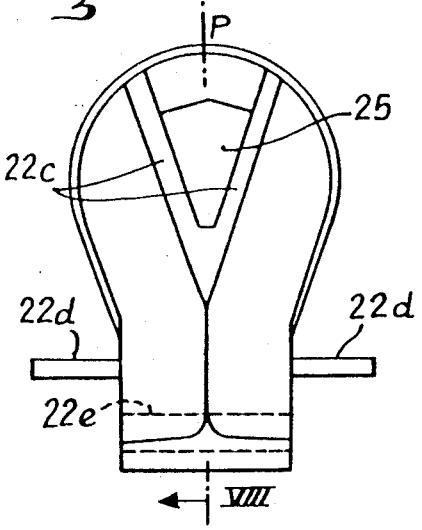
FIG. 7 is a front view of the plate of FIG. 6, as seen from the left of this figure.
Figure 8:
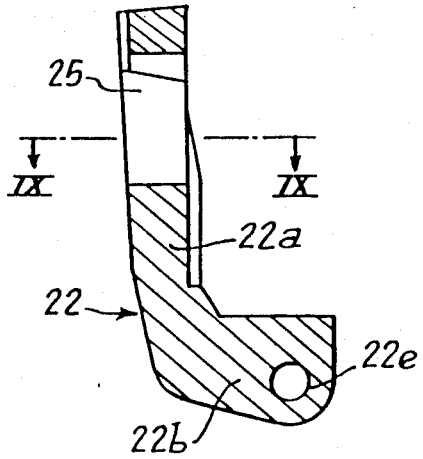
FIG. 8 is a vertical and longitudinal cross-sectional view along line VIII—VIII of FIG. 7.
Figure 10:
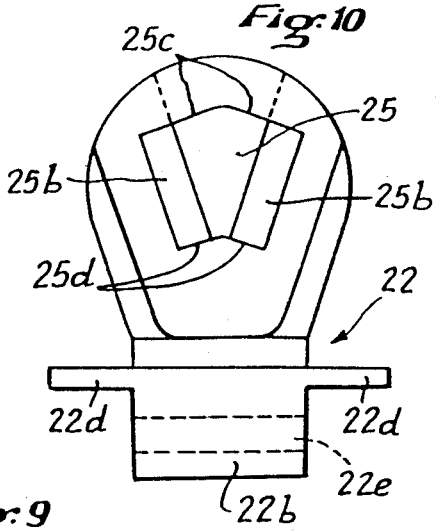
FIG. 10 is a front view of the plate as seen from the right of FIG. 6.

Linkage arm 23 is shown in a detailed manner is FIGS. 11–13. Arm 23 comprises an interior portion 23*b* at the end of which is formed, on its upper surface, nipple or pin or stud 27. Arm 23 also comprises a posterior portion 23*c* which is slightly inclined upwardly, and extends toward the rear. The posterior edge of portion 23*c* is cut away with a notch 23*d* which defines, at the two ends, the two lateral wings 23*a* which form a cap. Wings 23*a* are bored with transverse and coaxial holes 23*e* for the passage of journal axis pin 24. Wings 23*a* form a cap for axis pin 24.

Figure 14:
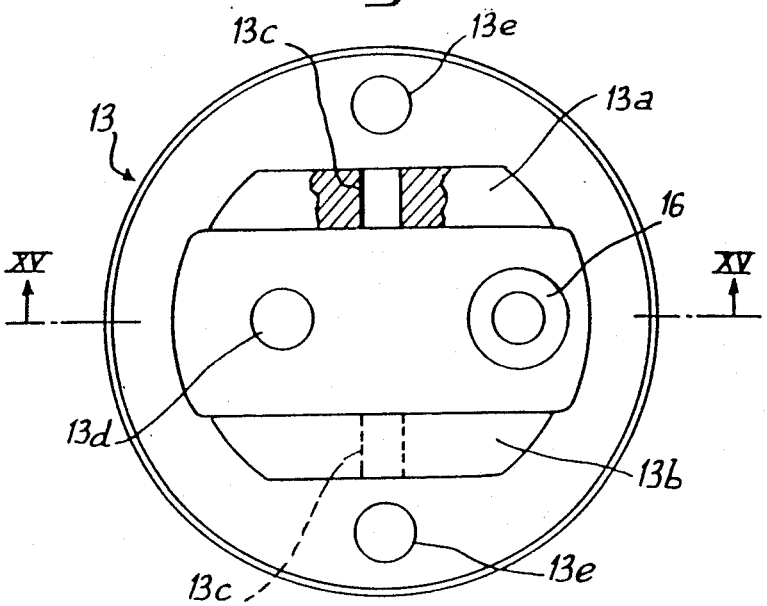
FIG. 14 is a planar view, partially in horizontal cross-section, of the base of the auxiliary mechanical abutment.
Figure 15:
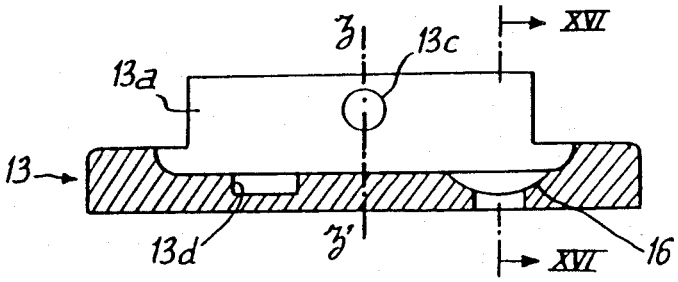
FIG. 15 is a vertical and longitudinal cross-sectional view along line XV—XV of FIG. 14.
Figure 16:
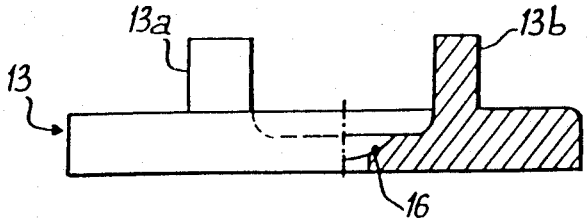
FIG. 16 is a view, half in profile and half in transverse cross-section, along line XVI—XVI of FIG. 15.

FIGS. 14–16 show in a detailed manner base or socket 13 which serves as a support for bearing 15, locking mechanism 12 and locking lever 17. Base 13 has, on its upper surface, two longitudinal and vertical wings 13*a*, 13*b* between which is lodged or engaged the pivotable locking lever 17. These two wings 13*a* and 13*b* are, respectively, bored with coaxial transverse holes 13*c* adapted to engage journal axis pin 18 of lever 17. Seat 16 for bearing 15 is formed in the upper surface of base 13 in the anterior zone positioned between the two vertical wings 13*a* and 13*b*. In the posterior zone defined by the two wings 13*a* and 13*b* an opening or recess 13*d* is provided which comprises a housing for return spring 19 of lever 17. Base 13 is likewise bored with holes 13*e* for the passage of the screws attaching the binding to the ski.

Figure 17:
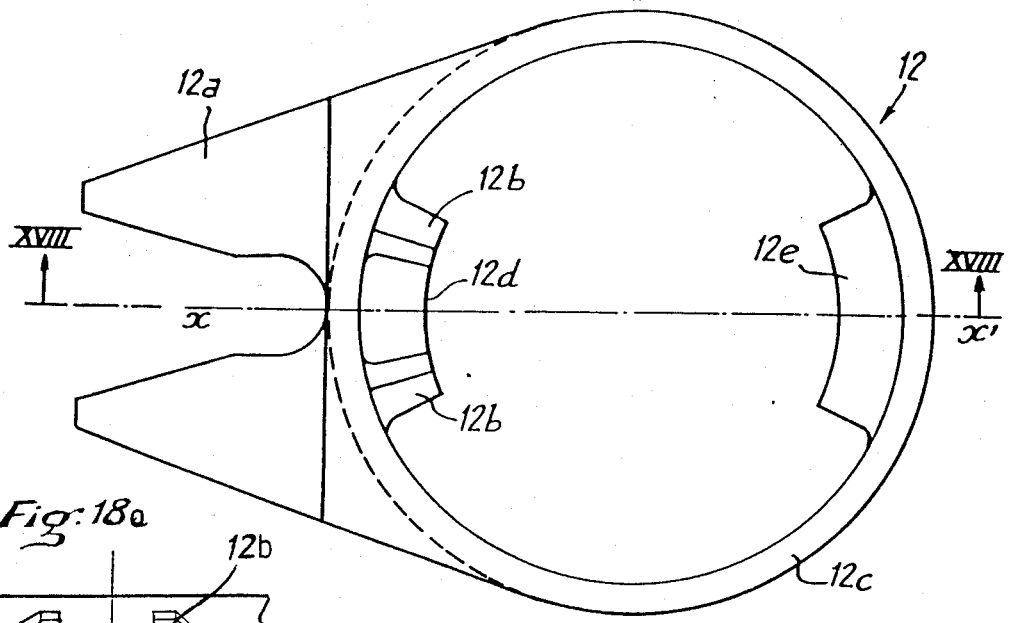
FIG. 17 is a planar view of the locking mechanism of the auxiliary mechanical abutment.
Figure 18A:
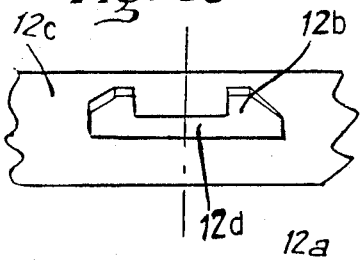
FIG. 18*a* is a partial view along F of the FIG. 18 showing the teeth 12*b;*
Figure 18:
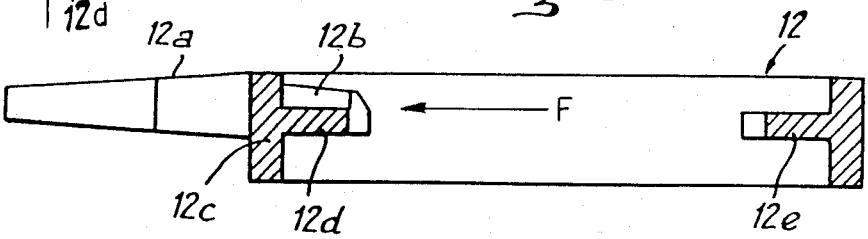
FIG. 18 is a vertical and longitudinal cross-sectional view along line XVIII—XVIII of FIG. 17.
Figure 19:
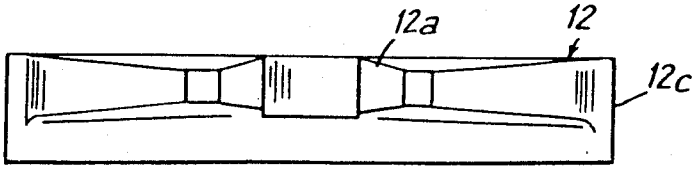
FIG. 19 is a profile view of the locking mechanism as seen from the left of FIG. 18.
Figure 20:
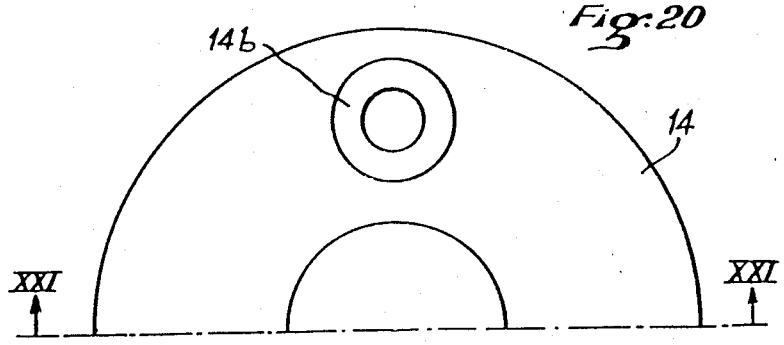
FIG. 20 is a half planar view of the cover of the auxiliary mechanical abutment.
Figure 21:
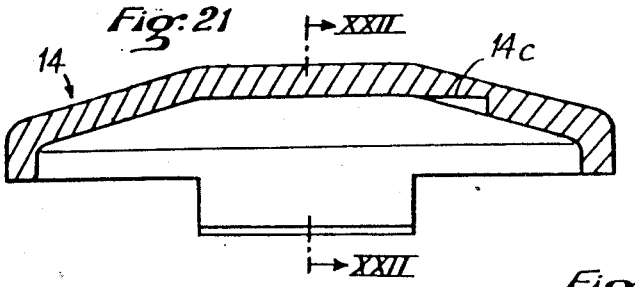
FIG. 21 is a vertical and longitudinal cross-sectional view along line XXI—XXI of FIG. 20.
Figure 22:
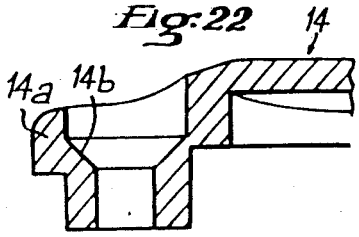
FIG. 22 is a partial transverse cross-sectional view along line XXII—XXII of FIG. 21.
Figure 23:
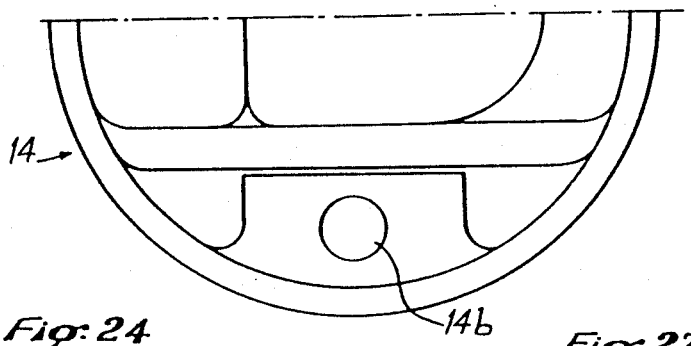
FIG. 23 is a bottom half view of the cover of the auxiliary mechanical abutment.
Figure 24:
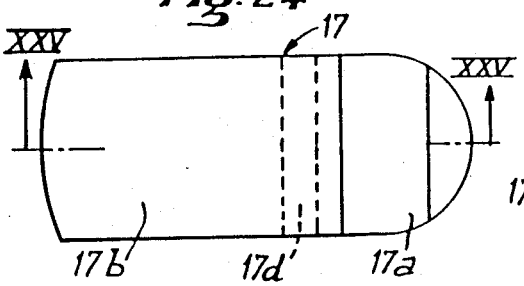
FIG. 24 is a planar view of the locking lever of the auxiliary mechanical abutment.
Figure 27:
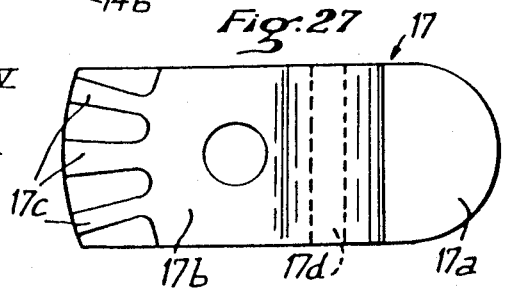
FIG. 27 is a bottom view of the locking lever.
Figure 25:
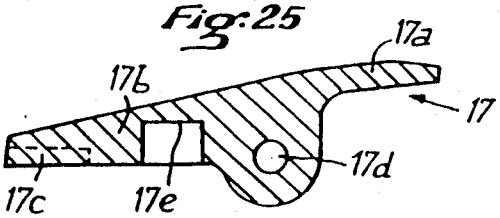
FIG. 25 is a vertical and longitudinal cross-sectional view along line XXV—XXV of FIG. 24.
Figure 26:
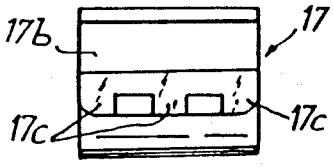
FIG. 26 is a profile view of the locking lever, as seen from the left of FIG. 25.

Locking mechanism 12 which is rotatably mounted on base 13 is shown in a detailed manner in FIGS. 17–19. Locking mechanism 12 comprises a cylindrical skirt 12*c* which extends radially towards the exterior of mechanism 12. Locking mechanism 12 also comprises extension 12*a* which forms a fork, extending to the rear of mechanism 12, from skirt 12*c*. Cylindrical skirt 12*c* also supports two internal collar portions: posterior collar 12*d* and anterior collar 12*e*, which are in the same transverse plane positioned substantially at the mid-height of skirt 12*c*. The two collars 12*d* and 12*e* are disposed diametrically opposite one another on opposite sides of skirt 12*c* and are substantially arc-shaped. These two internal collars 12*d* and 12*e* are aligned along longitudinal axis xx' when locking mechanism 12 is in the rest position as is shown in FIGS. 17–19. Arc-shaped collars 12*d* and 12*e* are supported on corresponding marginal portions of the upper surface of base 13, thereby permitting locking mechanism 12 to rotate around substantially vertical axis zz'. Locking element 12 is maintained laterally as a result of the engagement of the lower portion of cylindrical skirt 12*c* with the lateral surface of base 13.

Arc-shaped collar 12*d* which is adjacent to fork 12*a* and which is situated under posterior branch 17*b* of locking lever 17, supports on its upper surface, at least one notch 12*b* adapted to cooperate with at least one tooth 17*c* on locking lever 17 described in detail below. It is also within the scope of the invention to provide collar 12*d* with at least one tooth adapted to engage at least one notch on lever 17 as will also be described below.

Cover 14 which caps base 13 and the inertial control means, which comprises locking lever 17 and bearing 15, is shown in detail in FIGS. 20–23. This cover, which is in the form of a circular capsule, comprises two protuberances 14*a* which are disposed diametrically opposite to one another on opposite sides of cover 14. Vertical passages 14*b* are provided in protuberances 14*a* for attachment screws which also extend through passages 14*b* and holes 13*e* of base 13, to assure the attachment of cap 14 and base 13 of auxiliary mechanical abutment 11 to the ski. Above anterior arm 17*a* of locking lever 17, cover 14 may be provided with a hollow portion 14*c* adapted to permit anterior arm 17*a* of lever 17 to position itself therein when the lever is raised by means of bearing 15 as will be explained below.

Locking lever 17 is shown in detail in FIGS. 24–27. Lever 17 comprises, in its lower portion, a reinforcement or a section of greater thickness than the rest of lever 17, in which a transverse hole 17*d* is formed for the passage of journal axis pin 18. In the lower surface of posterior arm 17*b* of lever 17, a recess or opening 17*e* is provided which comprises a seat for the extreme upper portions of the return spring 19. Posterior arm 17*b* also has on its lower surface one or more teeth 17*c* adapted to cooperate with notches 12*b* of locking mechanism 12, as was previously discussed. Alternatively, the lower surface of arm 17*b* can comprise one or more notches therein, adapted to cooperate with one or more teeth 12*b* of locking mechanism 12.

Figure 28:
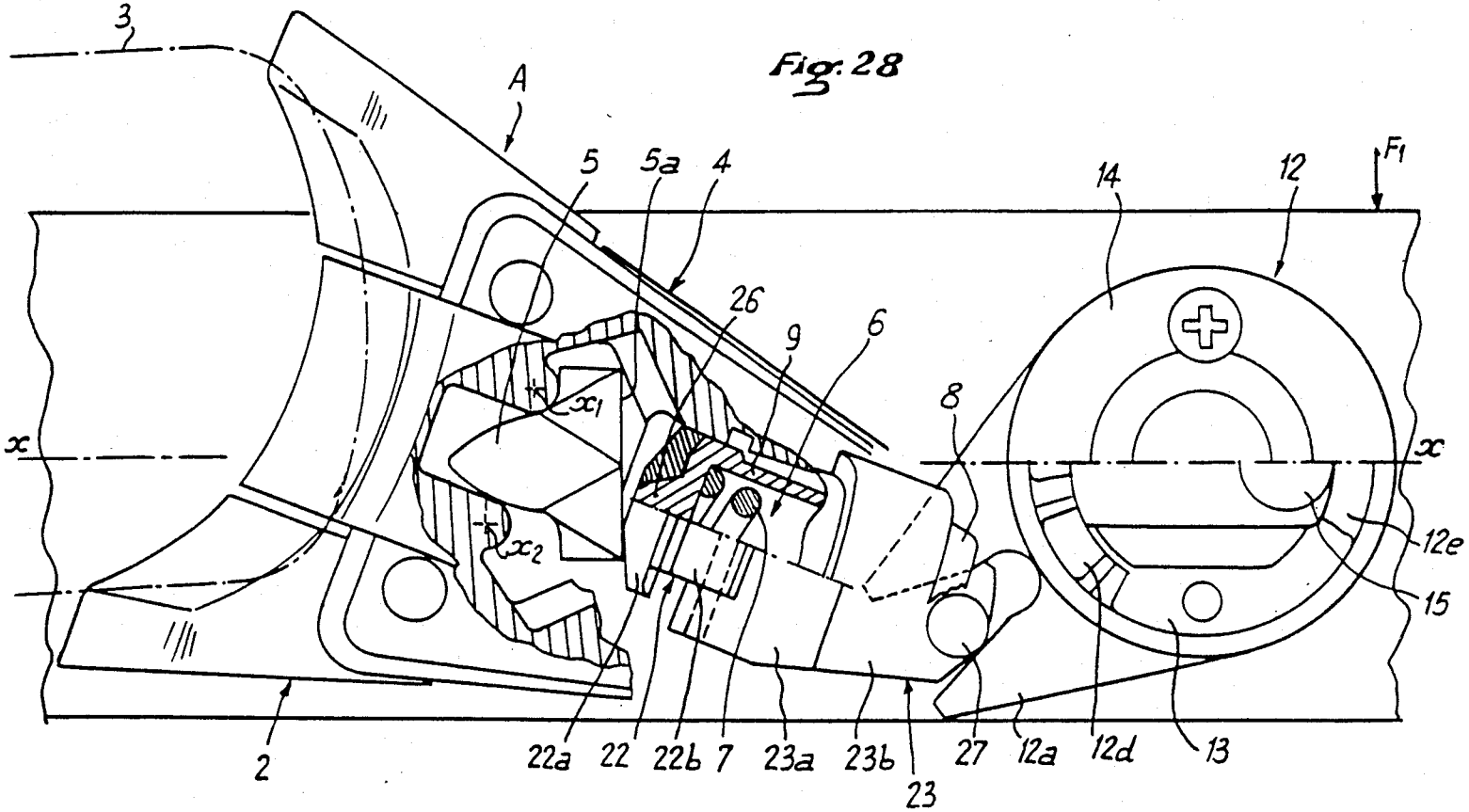
FIG. 28 is a view similar to that of FIG. 2, the safety binding being shown during a release as a result of the application of a slow force.
Figures 29, 29A:
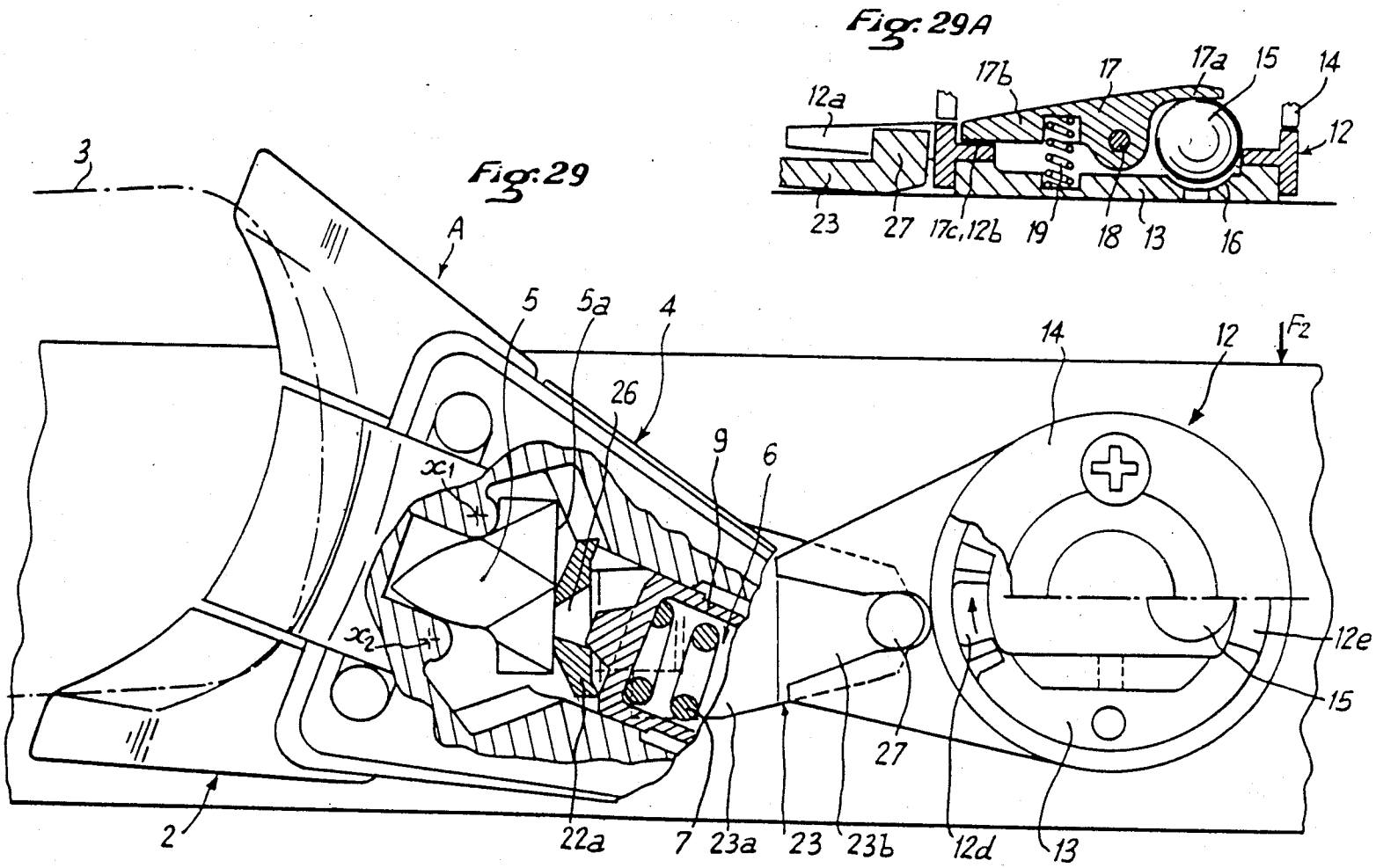
FIG. 29 is a view similar to that of FIG. 2, the safety binding being shown during a release as a result of a shock.
FIG. 29A is a vertical and longitudinal cross-sectional view of the inertial control means of the auxiliary mechanical abutment in the operative position in the case of a shock.

The operation of the safety binding which has been described above will now be explained with reference to FIGS. 28 and 29. FIGS. 28 and 29 illustrate the lateral release of the safety binding, respectively, in the event of a slow force, i.e., a force exhibiting a slow increase in intensity, and in the case of a brief and intense force, i.e., a "shock".

In FIG. 28, where the force exerted has a slowly increasing intensity, safety binding A releases the boot under the normal conditions for which it has been previously adjusted. In this case, the inertial control mechanism formed by bearing 15, lever 17 and locking mechanism 12, does not effect the bias on jaw 2, and bearing 15, by virtue of the return spring, rests in its seat 16, as is illustrated in FIG. 1. As a result, posterior arm 17*b* of lever 17 is lifted, away from locking mechanism 12 under the action of return spring 19, and consequently teeth 17*c* (or notches) of the posterior arm 17*b* of lever 17 are spaced from notches 12*b* (or teeth) of locking mechanism 12. Locking mechanism 12 can thus substantially freely rotate around vertical axis zz'. Consequently, if a slow transverse force, i.e., having a slow increase in its intensily, such as is illustrated by arrow F1 in FIG. 28, is exerted on ski 1, safety binding A releases the boot under the normal condition, i.e., when the release threshold (which is dependent on the extent of compression of spring 7) is reached. When this release threshold is reached, the assembly of jaw 2 and body 4 pivots substantially freely around one of the lateral support lines. In the example illustrated, in FIG. 28 the assembly pivots around the left support line $x_1$, because this example shows a release towards the left.

During this release, plate 22 and arm 23 pivot with body 4 and plate 22 slides on anterior surface 5*a* of support element 5. More specifically, support strips 22*c* slide on anterior surface 5*a*. By virtue of this relative displacement plate 22 and of piston 9 with respect to support element 5, the point at which the force of return spring 7 is applied to support 5 is spaced from the longitudinal plane of symmetry xx'. As a result, this force generates an opposing return torque which tends to pivot the pivotable assembly of the binding around the lateral support line $x_1$ in the counter-clockwise direction, to bring the assembly into the rest position. During the course of release as seen in FIG. 28, arm 23 causes, by means of pin or nipple 27, the rotation of locking mechanism 12 which can rotate substantially freely around vertical axis zz'.

The operation of safety binding A will now be described when a brief and intense force or shock is exerted on the ski, as is illustrated in FIGS. 29 and 29A. The lateral shock applied to ski 1 is shown by arrow $F_2$ in FIG. 29. Under the effect of shock $F_2$, bearing 15 disengages from the bottom of its seat 16 and as a result rises slightly on the wall of its seat. The upward displacement of bearing 15 serves to pivot locking lever 17 in the counterclockwise direction around axis pin 18 so that teeth 17*c* (or notches) engage notches 12*b* (or teeth) of locking mechanism 12. As a result, this locking mechanism is immobilized and cannot rotate. The same is true for nipple or pin 27. Thus, linkage arm 23 as well as plate 22 integral with nipple 27 can only pivot around an axis perpendicular to the ski passing through the center of stud or nipple 27. Consequently, piston 9, which can slide longitudinally in body 4 against spring 7, moves plate 22. This is accomplished by the contact between ramps 26*b* and opening 25 in plate 22. However, plate 22 can only pivot around nipple 27 while remaining resting on support element 5. This causes plate 22 to move in a new trajectory which, in turn, causes an additional compression of spring 7 as compared to the compression of this spring under normal conditions. As a result, a return moment opposing release is produced that is greater than that which is obtained when plate 22 pivots together with piston 9. Consequently, the release threshold in the case of a shock F2 is greater than the value of the release threshold when a slow force is applied. Thus, according to the above description, safety binding A is "hardened" temporarily in case of a shock, by virtue of the actuation or intervention of auxiliary mechanical abutment 11. In addition, under normal conditions when the force exerted is not a shock, but rather, is a slow force, binding A provides a normal release.

Figure 30:
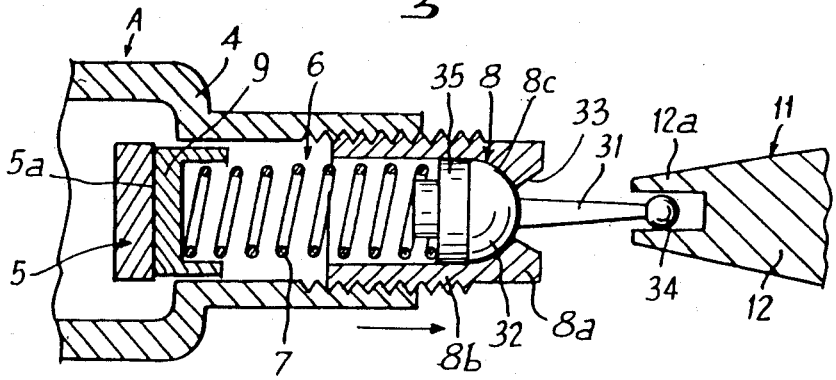
FIG. 30 is a partial schematic horizontal cross-sectional view of a first embodiment of the safety binding of the present invention, in the rest position.
Figure 31:
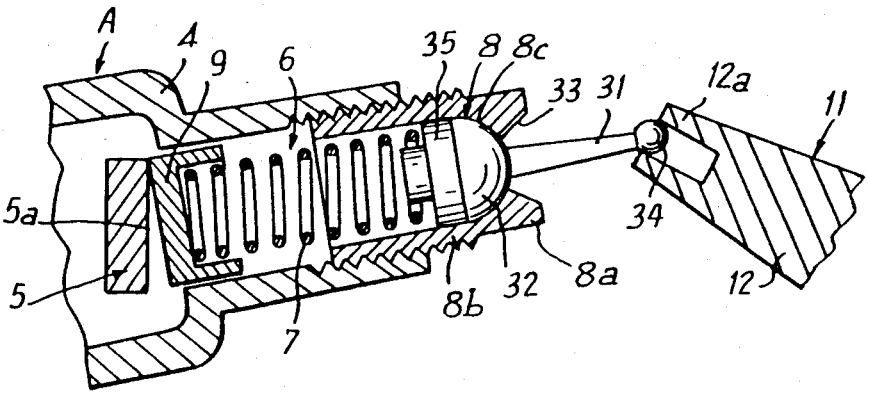
FIGS. 31 and 32 are horizontal cross-sectional views similar to that of FIG. 30, respectively, of a release due to a slow force, and of a release as the result of a shock.
Figure 32:
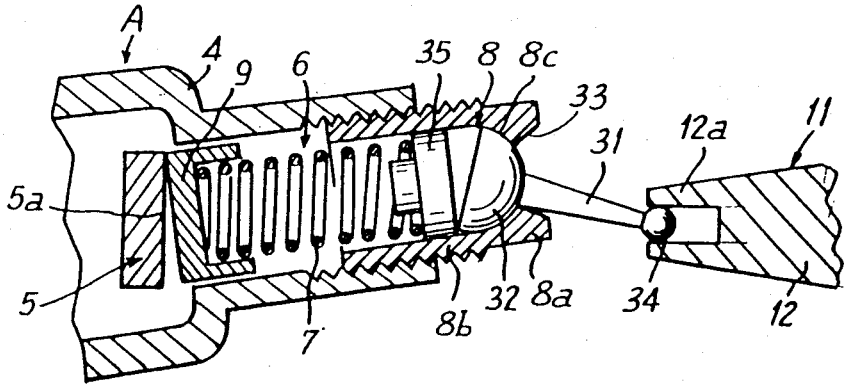

An alternative embodiment of the invention is illustrated in FIGS. 30–32. In this embodiment auxiliary mechanical abutment 11 is coupled to an intermediate linkage element 31 which varies the tension of spring 7 of elastic energization mechanism 6 when the inertial control means moves into the operative position as a result of a shock. This intermediate linkage element 31 comprises a shaft on pivoting body 4 which extends from body 4 toward the front. Shaft 31 is integral with a substantially hemispherically shaped head 32 which is lodged in the bottom of cap 8. The bottom of cap 8 has an internal surface 8*c* which is also substantially hemispherically shaped to form a seat for head 32. Shaft 31 projects axially towards the exterior through a central hole 33 in the bottom of cap 8. At its interior end shaft 31 preferably comprises a sphere 34 which is lodged in or engaged with fork 12*a* of locking mechanism 12. Sphere 34 is substantially equivalent of stud or nipple 27 of the previously described first embodiment.

Cap 8 also comprises a cylindrical skirt 8*b* having an external thread by which cap 8 is screwed in the threading provided in the anterior portion of body 4. A portion of compression spring 7 is disposed within cylindrical skirt 8 and is supported at one end on a piston 35. Piston 35 is interposed between spring 7 and the plane transverse diametral surface of substantially hemispherically shaped head 32.

FIG. 31 illustrates a release of the safety binding shown in FIG. 30 when a slow force is applied to the binding. In this case locking mechanism 12 is not immobilized by the inertial control means and it can, thus, rotate substantially freely. As a result, safety binding A can laterally release under normal conditions as soon as the value of the force applied to the leg of the skier exceeds the threshold value of spring 7.

If the leg of the skier is subjected to a shock, the inertial control means intervenes and actuates abutment 11, as in the preceeding case, to immobilize the locking mechanism 12, as is shown in FIG. 32. As a result, safety binding A can pivot to assure lateral release only by overcoming a force exerted by compression spring 7 greater than the force exerted by spring 7 under normal conditions seen in FIG. 31. In the release position illustrated in FIG. 32, linkage rod 31, whose spherical end 34 is always maintained immobile by locking mechanism 12, has pivoted with respect to cap 8 and body 4, so as to assume an inclined position with respect to the longitudinal axis thereof. As a result, subtantially hemispherically shaped internal head 32 pivots on its seat 8*c*, and pushes internal piston 35. In addition, a portion of head 32 separates from piston 35 as seen in FIG. 32. This biasing of piston 35 by head 32 causes an additional compression of spring 7 and consequently an increase of the tension thereof. In other words, the force exerted by spring 7 on principal piston 9 which is applied against support element 5 is increased. Thus, the release threshold of the binding in the event of a shock is increased as compared to that existing under normal conditions in which a slow force acts on the leg of the skier.

Figure 33:
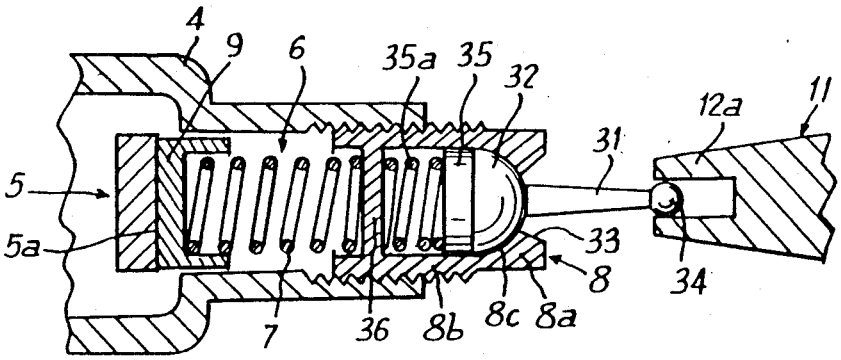
FIG. 33 is a partial horizontal cross-sectional view of a second embodiment of the safety binding of the present invention.
Figure 34:
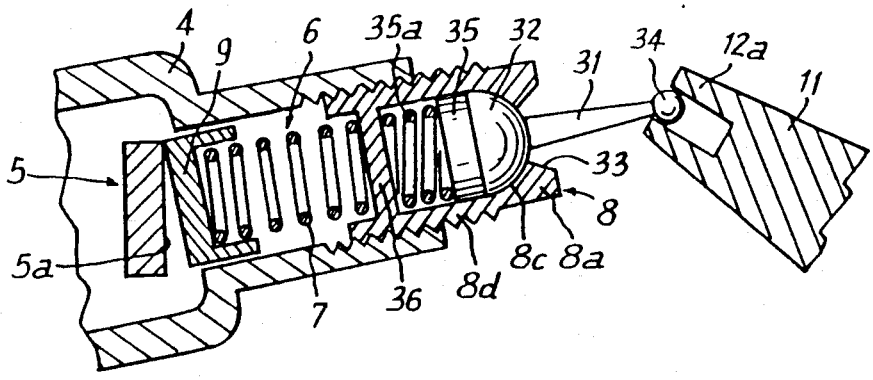
FIGS. 34 and 35 are views similar to that of FIG. 33, respectively, in the case of release under a slow force and in the case of release as a result of a shock.
Figure 35:
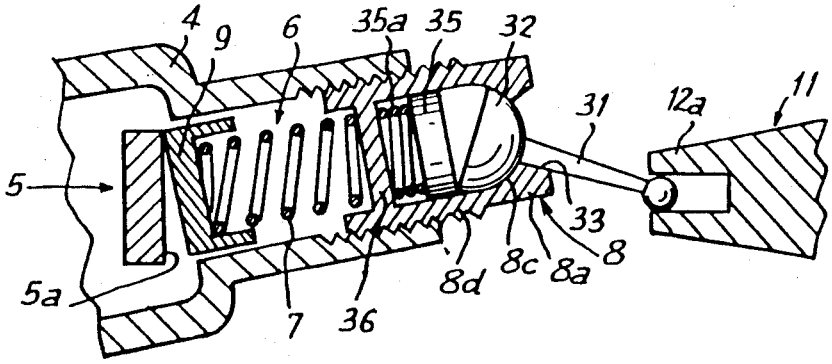

A third embodiment of the safety binding of the present invention is illustrated in FIGS. 33–35. In this embodiment the auxiliary mechanical abutment 11 is coupled to an intermediate linkage element 31, similar to that illustrated in the second embodiment seen in FIGS.

30–32. However, in this embodiment, substantially hemispherically shaped head 32, acts on an additional or secondary elastic mechanism or spring 35*a* not found in the second embodiment. This spring 35*a* is positioned in a chamber in cap 8 defined by transverse divider 36 and the bottom of cap 8. Auxiliary piston 35 and spring 35*a* are disposed in this chamber. More specifically, spring 35*a* is positioned between auxiliary piston 35 and one side of a transverse divider 36 of cap 8. Primary spring 7 is compressed between principal piston 9 and the other side of transverse divider 36 of cap 8.

The operation of the binding illustrated in FIGS. 33–35 is substantially the same as that of the binding illustrated in FIGS. 30–32. Under normal conditions the release threshold is defined by the tension of primary spring 7. Furthermore, in the event of a shock, linkage shaft 31 causes, by means of auxiliary piston 35, the compression of additional spring 35*a* which exerts a longitudinal force on intermediate divider 36, in the direction of support element 5. This additional force is added to the force normally created by primary spring 7 and, as a result, the release threshold of the binding is increased in the case of a shock. In other words, the binding is "hardened" in the event of a shock.

Figure 36:
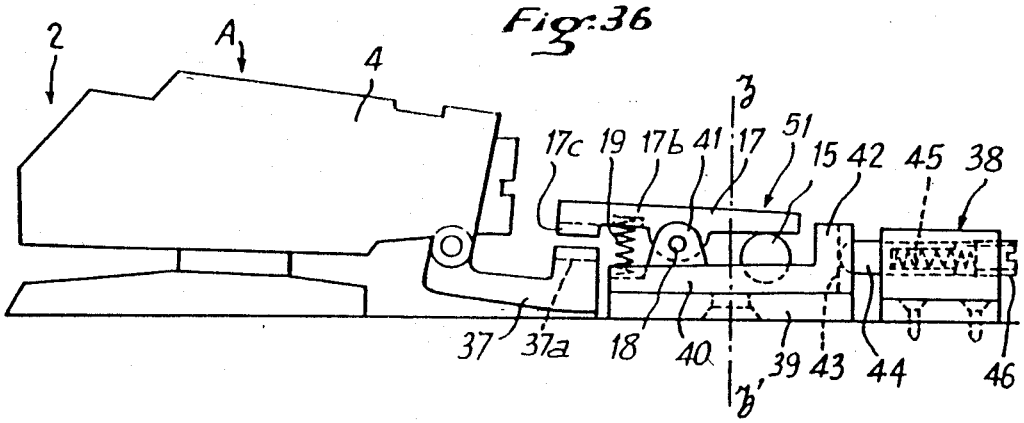
FIG. 36 is an elevational view of a third embodiment of the safety binding of the present invention in which the auxiliary mechanical abutment is itself biased against movement, the inertial control means being in the rest position.
Figure 37:
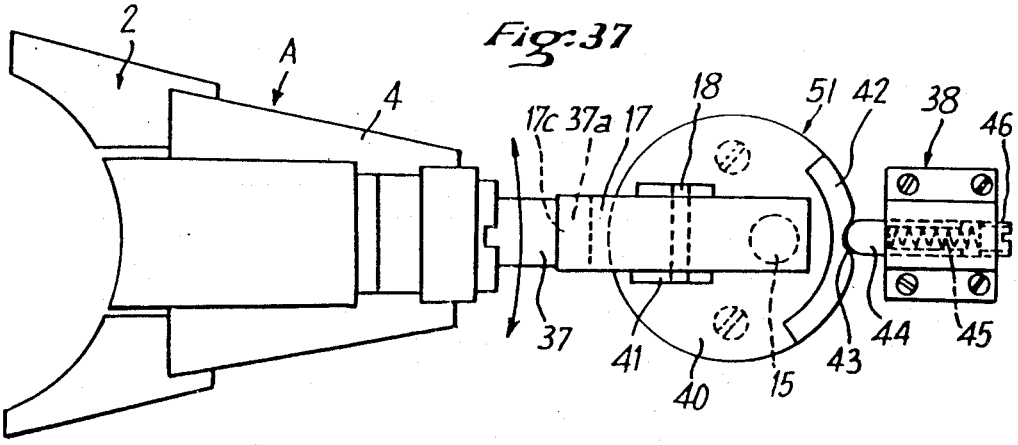
FIG. 37 is a planar view of the safety binding shown in FIG. 36, in the rest position.
Figure 38:
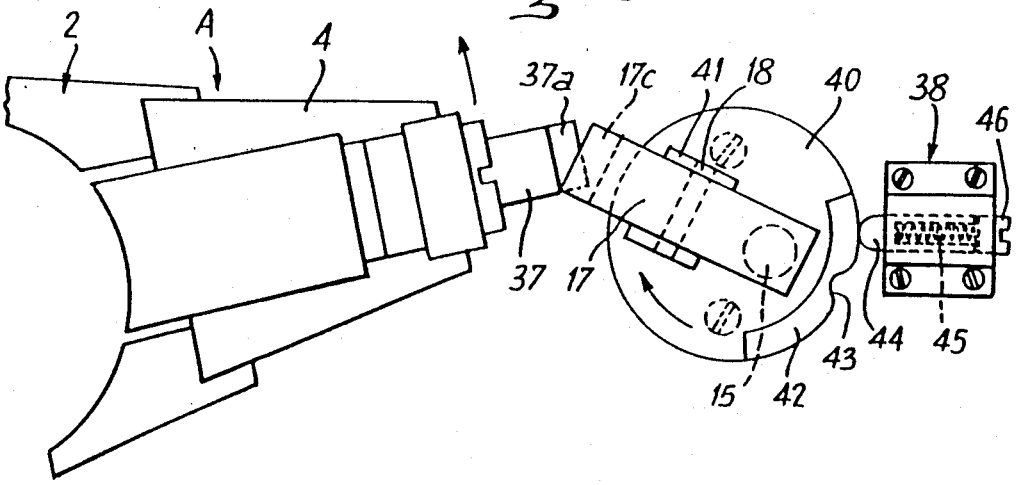
FIG. 38 is a planar view of the bindings of FIGS. 36 and 37 in the case of a release as the result of a shock.

Another alternative embodiment of the invention is illustrated in FIGS. 36–38. In this embodiment the inertial control means comprises ball bearing 15 and lever 17. The inertial control means is adapted to establish a coupling between an intermediate linkage element 37, integral with the pivoting unit comprising jaw 2 and body 4, and an auxiliary mechanical abutment 51. Abutment 51 is biased against movement by an additional energization mechanism 38. Intermediate linkage element 37 comprises an arm extending frontwardly from body 4. On its upper surface arm 37 has at least one notch 37*a* adapted to engage at least one tooth 17*c* provided at the lower end portion of the posterior arm 17*b* of locking lever 17. Alternatively, the upper surface of arm 37 has at least one tooth adapted to engage at least one notch on the lower surface of the end of posterior arm 17*b* or lever 17. Furthermore, lever 17 and bearing 15 are supported by a horizontal disk 40 rotatably mounted around the substantially vertical axis zz′, on a lower base or socket 39 attached to the ski. Disk 40 comprises a platform 41 which supports journal axis pin 18 of locking lever 17 and it also has on its upper surface a seat in the form of a spherical cap to receive ball bearing 15.

On the opposite side of disk 40 from intermediate linkage arm 37, a substantially vertical peripherial rib 42, is provided on disk 40. Rib 42 is substantially cylindrically shaped, and is provided with a notch 43, positioned in the longitudinal plane of symmetry of the binding in the rest position. A longitudinal button or projection 44, which is integral with the additional energization mechanism 38, is adapted to engage notch 43 as will be discussed below. Button 44 is biased rearwardly by a spring 45 whose tension can be adjusted by a screw 46.

It is evident from the preceeding description that auxiliary mechanical abutment 51 is maintained in the rest position by button 44 engaging recess 43 under the action of spring 45.

Under normal conditions, binding A can release by pivoting freely around one of the lateral support lines $x_1$, $x_2$, as in the case of FIGS. 1 and 2. This pivoting can occur because locking lever 17 is not coupled to intermediate linkage arm 37.

When the leg of the skier is subjected to a shock, the inertial control means intervenes and actuates abutment 51 by lifting ball bearing 15. The lifting of bearing 15 pivots lever 17 in the counterclockwise direction, as was previously discussed. As a result, the tooth or teeth (or notches) 17*c* of lever 17 engage notches (or teeth) 37*a* of the intermediate linkage arm 37, thereby coupling arm 37 to the auxiliary mechanical abutment 51. As a consequence, binding A becomes coupled to disks 40. Disk 40 which supports lever 17 is retained and biased against rotation by additional energization mechanism 30 whose button or projection 44 engages notch 43. For the release of the binding to occur, the force exerted by the boot of the skier on jaw 2 must exceed the sum of the force of the spring of the internal energization mechanism of safety binding A and the force of the additional energization mechanism 38. If this occurs, binding A releases laterally, as is illustrated in FIG. 38. In this case the release threshold is greater than the release threshold under normal conditions. FIG. 38 shows that auxiliary mechanical abutment 51 has pivoted, due to the force exerted by the intermediate linkage arm 37 against the force exerted by the additional energization mechanism 38. Safety binding A is thus "hardened" because auxiliary mechanical abutment 51 is subjected to the action of additional energization mechanism 38.

The inertial control means which causes auxiliary mechanical abutment 11 or 51 to intervene and increase the release threshold, depending upon whether or not there is a shock, can be formed in different ways. In the various embodiments illustrated in the drawings, these inertial control means use locking lever 17 activated by bearing 15. However, one could also use other inertial mechanisms for this purpose. For example, the inertial control means can comprise movable masses that in the event of a shock, by virtue of their inertia, act, in turn on locking mechanisms animated with a given movement, for example a sliding movement.

Figure 39:
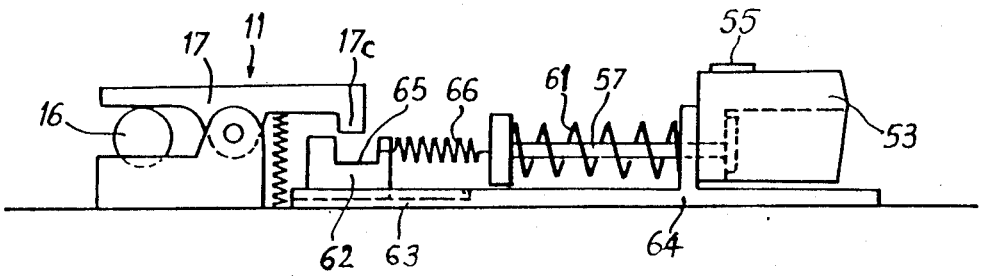
FIG. 39 is a schematic elevational view of another embodiment of the safety binding of the present invention in which the maintenance element of the shoe comprises two independent lateral retention wings.
Figure 40:
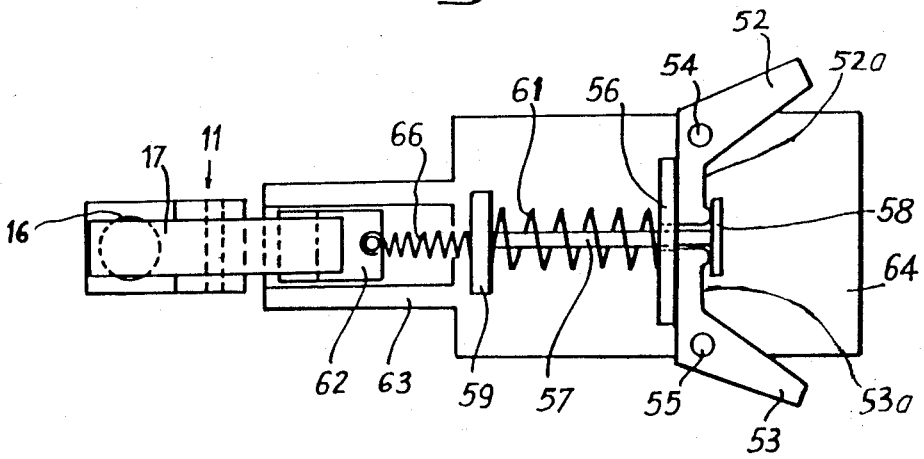
FIG. 40 is a schematic planar view of the binding of FIG. 39.

Such additional embodiments of the inertial control mechanism are shown in FIGS. 39 and 40. In the embodiment illustrated in FIGS. 39 and 40, the maintenance element of the boot comprises lateral retention wings 52, 53, positioned symmetrically with respect to the longitudinal plane of symmetry of the binding and ski. Wings 52 and 53 are adapted to be journalled, respectively, around axes 54 and 55 perpendicular to the ski. Wings 52 and 53 are normally biased, in the rest position, against a transverse support 56, by a rod or brace 57. Rod 57 passes through an opening in support 56. Rod 57 comprises a posterior head 58 at the posterior end thereof. Head 58 exerts a longitudinal force, on transverse arms 52*a*, 53*a*, of wings 52 and 53 which biases wings 52, 53 against support 56. Transverse arm 52*a* extends from wings 52 toward wing 53, and transverse arm 53*a* extends from wing 53 toward wing 52. In addition, rod 57 is integral, at its anterior end, with a transverse guide plate 59. A compression spring 61 is positioned between this plate 59 and support 56. In this manner, rod 57 is permanently biased frontwardly, thereby assuring, by means of its posterior head 58, the maintenance of the wings 52, 53 in the rest position. A safety binding of this type, having two lateral wings biased by a longitudinal rod 57, is described, for example, in French Pat. No. 2,210,422 and German Pat. No. 2,714,125, the disclosures of which are hereby incorporated by reference.

According to the invention, auxiliary mechanical abutment 11 is positioned in front of the binding and it acts on an element 62 slidably longitudinally mounted in an extension 63 of base 64 of the binding. This sliding element 62 has, in its upper surface, a notch 65 adapted to engage the lower tooth 17*c* provided at the end of the posterior arm of pivoting lever 17, whose anterior arm is subjected to the action of bearing 16. Sliding element 62 is in turn connected to transverse plate 59 integral with rod 57 by an auxiliary traction spring 66.

Thus, when the ski is subjected to a slow force, and consequently, the inertial control means 16, 17 remain at rest, sliding element 62 can slide substantially freely, and, consequently, the release threshold of the binding is defined only by the tension of principal compression spring 61, extending between transverse guide plate 59 and fixed support 56. This occurs because element 62 can slide substantially freely in the longitudinal direction, on extension 63 of base 64.

Conversely, in the event of a shock or intense force, causing the movement of the inertial control means 16, 17 into operating position, lever 17 pivots in the clockwise direction as shown in FIG. 39, so that its lower tooth 17*c* engages notch 65 and thus prevents sliding of element 62 towards the rear. As a result, transverse plate 59 is subjected to the action auxiliary spring 66 which is added to that of principal spring 61. Therefore, the release threshold of the binding is increased, i.e., the binding is "hardened".

Although the invention has been described with reference to particular means, materials and embodiments, it is to be understood that the invention is not limited to the particulars disclosed and extends to all equivalents within the scope of the claims.

What is claimed is:

1. A safety binding for holding a boot on a ski, and releasing the boot in response to an external force applied to the binding, wherein said boot is adapted to hold a leg of a skier therein, wherein said binding comprises:

(a) a maintenance element for releasably holding said boot on said ski, wherein said maintenance element is adapted to be displaced to release said boot;

(b) means for biasing said maintenance element against the release of said boot, wherein said biasing means produces a release threshold above which said maintenance element releases said boot in response to an external force on said binding above said release threshold; and (c) non-electronic means for selectively increasing said bias of said maintenance element against the release of said boot as a function of the duration of magnitude of said force, wherein said bias increasing means comprises:

(i) means for being displaced between rest and operating positions, wherein in said rest position said means for being displaced permits displacement of said maintenance element when said external force on said binding is greater than said release threshold;

(ii) means for displacing said means for being displaced into said operating position in response to a shock to said leg; and (iii) means for increasing said release threshold in response to positioning said means for being displaced into said operating position so that said maintenance element releases said boot only when said external force is greater than said increased release threshold.

2. The binding defined by claim 1 wherein said bias increasing means comprises:

an auxiliary mechanical abutment, attached to said ski, comprising an inertial control means for controlling said abutment, and comprising said means for being displaced, wherein said inertial control means is adapted to move from a rest position to an operating position in response to a shock, wherein in said rest position said abutment permits substantially free displacement of said maintenance element when said force is greater than said bias of said bias means, and in said operating position said abutment increases said bias of said maintenance element against release of said boot.

3. The binding defined by claim 2 further comprising linkage means linking said abutment with said maintenance element when said inertial control means is in said operating position.

4. The binding defined by claim 3, wherein said bias means is an elastic mechanism and wherein said linkage means comprises said release threshold increasing means which varies the tension of said elastic mechanism when said inertial control means is in said operating position.

5. The binding defined by claim 3 wherein said abutment further comprises locking means, connected to said linkage means when said inertial control means is in said operating position, wherein said locking means is biased against displacement when said inertial control means is in said operating position.

6. The binding defined by claim 5 wherein said abutment further comprises a base supporting said inertial control means and said locking means, wherein said locking means is selectively rotatably mounted on said base.

7. The binding defined by claim 6 wherein said locking means rotates substantially freely when said inertial control means is in said rest position, and is biased against rotation when said inertial control means is in said operating position.

8. The binding defined by claim 6 wherein said abutment further comprises a cover, covering said base and said inertial control means, comprising a circular capsule having two diametrically opposed protuberances each having a vertical opening therein, wherein said base further includes two openings and said binding further includes binding screws each of which is adapted to engage one opening in said protuberance and one opening in said base to attach said cover to said base.

9. The binding defined by claim 7 wherein said base comprises a spherical seat, and wherein said inertial control means comprises:

(i) a ball bearing comprising said displacing means and adapted to be supported on said seat; and (ii) a locking lever comprising said means for being displaced journalled around a transverse axis and comprising an anterior arm adapted to be supported on said ball bearing, and a posterior arm biased out of contract from said locking means when said inertial control means is in said rest position, and wherein said posterior arm has a portion adapted to contact a portion of said locking means to bias said locking means against rotation when said inertial control means is in said operating position.

10. The binding defined by claim 9 wherein said portion of said posterior arm has at least one notch thereon and said portion of said locking means has at least one tooth thereon.

11. The binding defined by claim 9 wherein said portion of said posterior arm has at least one tooth thereon and said portion on said locking means has at least one notch thereon.

12. The binding defined by claim 9 wherein said inertial control means further comprises a transverse axis pin around which said lever is adapted to pivot, and a return spring for biasing said lever out of contact with said locking means, wherein said base further comprises two longitudinal and vertical wings between which said lever is positioned, wherein each wing includes an opening adapted to receive said transverse axis pin, and wherein a lower portion of said posterior arm comprises a recess adapted to receive an upper end of said return spring.

13. The binding defined by claim 12 wherein said lever further comprises a reinforcement at a lower portion thereof having a transverse opening therein for receiving transverse axis pin.

14. The binding defined by claim 12 wherein said base further comprises openings therein and wherein said abutment further comprises attachment screws adapted to pass through said openings to attach said base to said ski.

15. The binding defined by claim 9 wherein said locking means comprises:

(i) a cylindrical skirt radially extending toward the exterior thereof;

(ii) a forked extension extending from said skirt toward the rear of said binding, in which said linkage means is adapted to engage; and (iii) an anterior and a posterior collar, extending from said skirt toward the interior of said locking means, and on opposite sides of said skirt, wherein the upper portion of said posterior collar in said portion of said locking means, and wherein the bottom portions of said collars are adapted to be supported on said base.

16. The binding defined by claim 15 wherein said collars are in substantially the same transverse plane, are substantially arc-shaped, and are disposed symmetrically with respect to the longitudinal axis of said binding when said locking mechanism is in said rest position.

17. The binding defined by claim 16 wherein said posterior collar comprises at least one notch on the upper surface thereof and wherein said portion of said lever comprises a tooth adapted to engage said notch when said inertial control means is in said operating position.

18. The binding defined by claim 16 wherein said posterior collar comprises at least one tooth on the upper surface thereof and wherein said portion of said lever comprises a notch adapted to engage said tooth when said inertial control means is in said operating position.

19. The binding defined by claim 5 wherein said binding further comprises:

a support, attached to said ski; and a body integral with said maintenance element, so as to form an assembly therewith, pivotable around said support to release said boot.

20. The binding defined by claim 19 further comprising means for controlling said bias against release of said boot, wherein said linkage means is connected to said control means.

21. The binding defined by claim 20 wherein said control means is part of said assembly.

22. The binding defined by claim 19 wherein said bias means comprises an elastic mechanism.

23. The binding defined by claim 22 wherein said support has an anterior surface and wherein said elastic mechanism comprises a spring and a piston, wherein said spring biases said piston toward said anterior surface of said support, and wherein said linkage means comprises a plate positioned between said anterior surface of said support and said piston.

24. The binding defined by claim 23 wherein said abutment further comprises a base and wherein said locking means is rotatably mounted on said base around a substantially vertical axis, wherein said locking means is biased against rotation by said inertial control means when said inertial control means is in said operating position.

25. The binding defined by claim 24 wherein said elastic mechanism further comprises adjustment means for adjusting the bias of said spring.

26. The binding defined by claim 25 wherein said adjustment means is an adjustment cap positioned at the end of said spring opposite the end of said spring in contact with said plate.

27. The binding defined by claim 25 wherein said piston has a protuberance thereon and said plate has an opening therein adapted to receive said protuberance.

28. The binding defined by claim 27 wherein said protuberance is positioned symmetrically with respect to a vertical and longitudinal plane of symmetry of said binding.

29. The binding defined by claim 28 wherein said protuberance has substantially a trapezoidal configuration in horizontal cross-section, and said opening is substantially in the shape of an isosceles trapezoid.

30. The binding defined by claim 29 wherein said protuberance comprises:

(i) a V-shaped front surface;

(ii) two lateral surfaces bordering on either side of said front surface, and inclined from the exterior to the interior of said piston in the direction of said support;

(iii) two upper surfaces inclined from the top to the bottom and toward the exterior of said piston and positioned symmetrically with respect to said vertical and longitudinal plane of symmetry of said binding; and (iv) two lower surfaces, positioned symmetrically with respect to said vertical and longitudinal plane of symmetry and inclined from said bottom to said top of said piston, toward the exterior of said piston.

31. The binding defined by claim 30 wherein said plate is a substantially vertical arm of said linkage means having said opening therein, wherein said opening is defined by:

(i) two lateral planar surfaces symmetrical with respect to said vertical and longitudinal plane of symmetry of said binding and having substantially the same inclination as said lateral surfaces on said protuberance and converging toward said support;

(ii) two upper surfaces inclined from the top to the bottom of said plate toward the exterior thereof;

(iii) two lower surfaces inclined from the top to the bottom of said plate toward the exterior, wherein said opening has a uncurved cross-section opposite from said support, substantially in the shape of an isosceles trapezoid having two bases, one smaller than the other, wherein said smaller base is directed downwardly and wherein said larger base has a uncurved cross-section comprising two inclined sides each of which is part of a different symmetrical rectangular trapezium.

32. The binding defined by claim 27 wherein said opening is adapted to permit angular displacement of said protuberance with respect to said opening during pivoting of said assembly.

33. The binding defined by claim 27 wherein said vertical arm has a posterior surface, and wherein said arm further comprises two strips on said posterior surface, together having a V-shaped configuration, wherein said strips are adapted to contact said anterior surface of said support.

34. The binding defined by claim 27 wherein said plate comprises a substantially vertical arm and wherein said linkage means further comprises a substantially horizontal arm having a posterior end journalled on an anterior end of said substantially vertical arm, and an anterior end adapted to engage said abutment.

35. The binding defined by claim 34 wherein said linkage means further comprises a transverse axis pin and wherein said substantially horizontal arm is journalled around said transverse axis pin and wherein said substantially horizontal arm further comprises a nipple, extending upwardly from said anterior end and adapted to engage said abutment.

36. The binding defined by claim 35 wherein said posterior end of said horizontal arm has a notch therein, wherein said notch defines two lateral wings at each transverse end thereof, wherein each wing has an opening therein adapted to receive said transverse axis pin, and wherein said lateral wings form a cap for said axis pin.

37. The binding defined by claim 5 further comprising a support on said ski, and a body, integral with said maintenance element to form an assembly pivotable around said support, and wherein said bias means is an elastic means that is part of said assembly, and wherein said linkage means increases the tension of said bias means when said inertial control means is in said operating position.

38. The binding defined by claim 37 wherein said assembly further comprises an adjustment cap for adjusting the tension of said elastic means and having an opening therein, and wherein said adjustment cap comprises an auxiliary piston slidingly mounted therein, and wherein said linkage means comprises a shaft having a posteriior end engaging said locking means, and an anterior end having a substantially hemispherically shaped head integral therewith and engaging said adjustment cap, wherein said shaft extends through said opening in said adjustment cap, and wherein said auxiliary piston is biased against a diametral surface of said substantially hemispherically shaped head by said elastic means.

39. The binding defined by claim 5 further comprising a support on said ski; a body, integral with said maintenance element to form an assembly pivotable around said support; and an additional bias means comprising said release threshold increasing means and being coupled to said linkage means, wherein the bias of said additional bias means is added to the bias of said bias means to bias said maintenance element against release of said boot when said inertial control means is in said operating position.

40. The binding defined by claim 39 wherein said bias means comprises a first elastic mechanism and said additional bias means comprises a second elastic mechanism, and wherein said assembly further comprises an adjustment cap for adjusting the tension of said first elastic system and wherein said adjustment cap comprises a transverse wall and a bottom portion, together defining a chamber, wherein said adjustment cap further comprises an opening therein; a substantially hemispherically shaped seat adjacent said opening; and wherein said second elastic mechanism and an auxiliary piston are disposed in said chamber, and wherein said linkage means further comprises a shaft having a posterior end engaging said locking means and an anterior end having a substantially hemispherically shaped head integral therewith and rotatingly mounted in said seat of said adjustment cap, wherein said shaft extends through said opening and said second elastic mechanism biases said auxiliary piston against a diametrical surface of said head.

41. The binding defined by claim 3 wherein said abutment is unattached to said linkage means when said inertial control means is in said rest position.

42. The binding defined by claim 41 wherein said linkage means is attached to said maintenance element and wherein a portion of said inertial control means contacts said linkage means when said inertial control means is in said operating position.

43. The binding defined by claim 42 wherein said bias increasing means biases said abutment against movement with said maintenance element when said inertial control means is in said operating position.

44. The binding defined by claim 43 wherein said binding further comprises a support, attached to said ski, and a body integral with said maintenance element to form a pivotable assembly pivotable about said support against the bias of said bias means, wherein said bias means is part of said pivotable assembly.

45. The binding defined by claim 44 wherein said linkage means is attached to said assembly and said abutment is adapted to be pivoted, wherein said bias increasing means biases said abutment against pivoting with said assembly when said inertial control means is in said operating position.

46. The binding defined by claim 45 wherein said release threshold increasing means comprises said linkage means, wherein said linkage means comprises an arm attached to said body of said binding and wherein said abutment further comprises:

(i) a base attached to said ski; and (ii) a disk rotatably mounted on said base having a seat thereon; and wherein said inertial control means comprises:

(i) a ball bearing comprising said displacing means supported by said seat; and (ii) a lever comprising said means for being displaced, journalled around a transverse axis, having an anterior arm biased into contact with said ball bearing when said inertial control means is in said rest position, and a posterior arm, spaced from said arm of said linkage means when said inertial control means is in said rest position.

47. The binding defined by claim 46 wherein said lever pivots so that said posterior arm contacts said arm of said linkage means when said inertial control means is in said operating position.

48. The binding defined by claim 47 wherein said disk is substantially horizontal and is adapted to pivot around a substantially vertical axis, and wherein said disk has an upper surface in which said seat is disposed.

49. The binding defined by claim 48 wherein said abutment further comprises a spring, disposed between said lever and said disk for biasing said anterior arm against said ball bearing when said inertial control means is in said rest position, and wherein said lever has a transverse opening therein and said disk further comprises a platform having a transverse opening therein, and a transverse axis pin adapted to engage said transverse opening in said lever and said platform.

50. The binding defined by claim 49 wherein said arm of said linkage means has an end comprising a notch and wherein said posterior arm comprises at least one tooth adapted to engage said notch when said internal control means is in said operating position.

51. The binding defined by claim 49 wherein said arm of said linkage means has an end comprising a tooth and wherein said posterior arm comprises at least one notch adapted to engage said tooth when said inertial control means is in said operating position.

52. The binding defined by claim 47 wherein said disk further comprises a groove thereon, and wherein said bias increasing means comprises a projection biased to engage said groove when said inertial control means is in said rest position.

53. The binding defined by claim 52 wherein said groove is positioned in the longitudinal plane of symmetry of said binding when said inertial control means is in said rest position, and wherein said notch is positioned on the opposite side of said disk from said linkage means.

54. The binding defined by claim 53 wherein said disk further includes a substantially vertical peripheral rib having said notch therein, and wherein said bias increasing means is attached to said ski and further comprises a spring adapted to bias said projection toward said notch.

55. The binding defined by claim 2 wherein said maintenance element comprises:

(i) two independent lateral retention wings each adapted to be journalled around a separate axis, wherein said bias means biases said wings against journalling around said axes, and wherein said release threshold increasing means comprises an additional bias means for additionally biasing said wings against journalling only when said inertial control means is in said operating position.

56. The binding defined by claim 55 wherein said bias means comprises a rod, contacting said wings, and a primary spring, wherein said primary spring biases said rod against said wings so as to bias said wings against journalling, and wherein said release threshold increasing means comprises an element slidingly mounted on said ski, and a secondary spring attached between said rod and said sliding element, and wherein said inertial control means comprises a lever adapted to engage said sliding element to prevent sliding movement thereof when said inertial control means is in said operating position, wherein said lever comprises said means for being displaced.

57. The binding defined by claim 56 wherein said wings are spaced apart and wherein said rod extends between said wing and wherein bias means further comprises:

(i) a head at the posterior end of said rod;

(ii) a support, on said rod spaced a sufficient distance from said head so that said head contacts one side of said wings and said support contacts the other side of said wings, wherein said primary spring biases said support against said other side of said wings in said rest portion; and (iii) a plate attached to the anterior end of said rod, wherein said secondary spring contacts said plate.

58. The binding defined by claim 57 wherein said binding further comprises a base extending from said wings to said sliding element, wherein said element is sliding adapted to slide on said base, and wherein said inertial control means further comprises a support, and a ball bearing comprising said means for being displaced on said support, wherein said lever has a posterior end is adapted to engage said sliding element when said inertial control means is in said operating position, and an anterior end adapted to engage said ball bearing when said inertial control means is in said rest position, wherein said lever is adapted to be spaced from said sliding element when said inertial control means is in said rest position.

59. The binding defined by claim 1 wherein said release threshold increasing means comprises means for preventing displacement of said maintenance element thereby preventing release of said boot in response to said shock.

60. The binding defined by claim 1 wherein said displacing means comprises means substantially instantaneously displacing said means for being displaced into said operating position in response to said shock.

61. The binding defined by claim 60 wherein said substantially instantaneous displacing means comprises means for substantially instantaneously displacing the entire means for being displaced into said operating position.

62. The binding defined by claim 1 wherein said maintenance element comprises;

means for being laterally displaced to release said boot in response to an external force above said release threshold when said bias increasing means is in said rest position; and means for being laterally displaced to release said boot in response to an external force above said increased release threshold when said bias increasing means is in said operating position.

63. A binding for holding a boot on a ski, comprising:

(a) a maintenance element adapted to releasably hold said boot on said ski in a rest position;

(b) an elastic mechanism adapted to bias said maintenance element into said rest position, wherein said elastic mechanism defines a release threshold, above which said maintenance element releases said boot;

(c) an auxiliary mechanical abutment adapted to be attached to said ski, comprising an inertial control mechanism adapted to occupy a rest position and an operating position, wherein said abutment increases said release threshold when said inertial control mechanism is in said operating position; and (d) means for linking said abutment with said maintenance element when said inertial control means is in said operating position, wherein said abutment further comprises locking means for locking said linkage means to said maintenance element when said inertial control means is in said operating position, and for unlocking said linkage means from said maintenance element when said inertial control means is in said rest position.

64. The binding defined by claim 63 wherein said linkage means varies the tension of said elastic mechanism when said inertial control means is in said operating position.

65. The binding defined by claim 63 wherein said abutment further comprises a base supporting said inertial control means and said locking means, wherein said locking means is selectively rotatably mounted on said base.

66. The binding defined by claim 65 wherein said locking means rotates substantially freely when said inertial control means is in said rest position, and is biased against rotation when said inertial control means is in said operating position.

67. The binding defined by claim 65 wherein said abutment further comprises a cover, covering said base and said inertial control mechanism, comprising a circular capsule having two diametrically opposed protuberances each having a vertical opening therein, wherein said base further includes two openings and said binding further includes binding screws each of which is adapted to engage one opening in said protuberance and one opening in said base to attach said cover to said base.

68. The binding defined by claim 66 wherein said base comprises a spherical seat, and wherein said inertial control mechanism comprises:

(i) a ball bearing adapted to be supported on said seat; and (ii) a locking lever, journalled around a transverse axis and comprising an anterior arm adapted to be supported on said ball bearing, and a posterior arm biased out of contact from said locking means when said inertial control means is in said rest position, and wherein said posterior arm has a portion adapted to contact a portion of said locking means to bias said locking means against rotation when said inertial control means is in said operating position.

69. The binding defined by claim 68 wherein said portion of said posterior arm has at least one notch thereon and said portion of said locking means has at least one tooth thereon.

70. The binding defined by claim 68 wherein said portion of said posterior arm has at least one tooth thereon and said portion on said locking means has at least one notch thereon.

71. The binding defined by claim 68 wherein said inertial control mechanism further comprises a transverse axis pin around which said lever is adapted to pivot, and a return spring for biasing said lever out of contact with said locking means, wherein said base further comprises two longitudinal and vertical wings between which said lever is positioned, wherein each wing includes an opening adapted to receive said transverse axis pin, and wherein a lower portion of said posterior arm comprises a recess adapted to receive an upper end of said return spring.

72. The binding defined by claim 71 wherein said lever further comprises a reinforcement at a lower portion thereof having a transverse opening therein for receiving transverse axis pin.

73. The binding defined by claim 71 wherein said base further comprises openings therein and wherein said abutment further comprises attachment screws adapted to pass through said openings to attach said base to said ski.

74. The binding defined by claim 68 wherein said locking means comprises:

(i) a cylindrical skirt radially extending toward the exterior thereof;

(ii) a forked extension extending from said skirt toward the rear of said binding, in which said linkage means is adapted to engage; and (iii) an anterior and a posterior collar, extending from said skirt toward the interior of said locking means, and on opposite sides of said skirt, wherein the upper portion of said posterior collar is said portion of said locking means, and wherein the bottom portions of said collars are adapted to be supported on said base.

75. The binding defined by claim 74 wherein said collars are in substantially the same transverse plane, are substantially arc-shaped, and are disposed symmetrically with respect to the longitudinal axis of said binding when said locking mechanism is in said rest position.

76. The binding defined by claim 75 wherein said posterior collar comprises at least one notch on the upper surface thereof and wherein said portion of said lever comprises a tooth adapted to engage said notch when said inertial control means is in said operating position.

77. The binding defined by claim 75 wherein said posterior collar comprises at least one tooth on the upper surface thereof and wherein said portion of said lever comprises a notch adapted to engage said tooth when said inertial control means is in said operating position.

78. The binding defined by claim 63 wherein said binding further comprises:

a support, attached to said ski; and a body integral with said maintenance element, so as to form an assembly therewith, pivotable around said support to release said boot wherein said elastic mechanism is part of said assembly.

79. The binding defined by claim 78 wherein said support has an anterior surface and wherein said elastic mechanism comprises a spring and a piston, wherein said spring biases said piston toward said anterior surface of said support, and wherein said linkage means comprises a plate positioned between said anterior surface of said support and said piston.

80. The binding defined by claim 79 wherein said abutment further comprises a base and wherein said locking means is rotatably mounted on said base around a substantially vertical axis, wherein said locking mechanism is biased against rotation by said inertial control mechanism when said inertial control means is in said operating position.

81. The binding defined by claim 80 wherein said elastic mechanism further comprises adjustment means for adjusting the bias of said spring.

82. The binding defined by claim 81 wherein said adjustment means is an adjustment cap positioned at the end of said spring opposite the end of said spring in contact with said plate.

83. The binding defined by claim 81 wherein said piston has a protuberance thereon and said plate has an opening therein adapted to receive said protuberance.

84. The binding defined by claim 83 wherein said protuberance is positioned symmetrically with respect to a vertical and longitudinal plane of symmetry of said binding.

85. The binding defined by claim 84 wherein said protuberance has substantially a trapezoidal configuration in horizontal cross-section, and said opening is substantially in the shape of an isosceles trapezoid.

86. The binding defined by claim 85 wherein said protuberance comprises:

(i) a V-shaped front surface;

(ii) two lateral surfaces bordering on either side of said front surface, and inclined from the exterior to the interior of said piston in the direction of said support;

(iii) two upper surfaces inclined from the top to the bottom and toward the exterior of said piston and positioned symmetrically with respect to said vertical and longitudinal plane of symmetry of said binding; and (iv) two lower surfaces, positioned symmetrically with respect to said vertical and longitudinal plane of symmetry and inclined from said bottom to said top of said piston, toward the exterior of said piston.

87. The binding defined by claim 86 wherein said plate is a substantially vertical arm of said linkage means having said opening therein, wherein said opening is defined by:

(i) two lateral planar surfaces symmetrical with respect to said vertical and longitudinal plane of symmetry of said binding and having substantially the same inclination as said lateral surfaces on said protuberance and converging toward said support;

(ii) two upper surfaces inclined from the top to the bottom of said plate toward the exterior thereof;

(iii) two lower surfaces inclined from the top to the bottom of said plate toward the exterior, wherein said opening has a uncurved cross-section opposite from said support, substantially in the shape of an isosceles trapezoid having two bases, one smaller than the other, wherein said smaller base is directed downwardly and wherein said larger base has a uncurved cross-section comprising two inclined sides each of which is part of a different symmetrical rectangular trapezium.

88. The binding defined by claim 81 wherein said opening is adapted to permit angular displacement of said protuberance with respect to said opening during pivoting of said assembly.

89. The binding defined by claim 81 wherein said vertical arm has a posterior surface, and wherein said arm further comprises two strips on said posterior surface, together having a V-shaped configuration, wherein said strips are adapted to contact said anterior surface of said support.

90. The binding defined by claim 87 wherein said plate comprises a substantially vertical arm and wherein said linkage means further comprises a substantially horizontal arm having a posterior end journalled on an anterior end of said substantially vertical arm, and an anterior end adapted to engage said abutment.

91. The binding defined by claim 90 wherein said linkage means further comprises a transverse axis pin and wherein said substantially horizontal arm is journalled around said transverse axis pin and wherein said substantially horizontal arm further comprises a nipple, extending upwardly from said anterior end and adapted to engage said abutment.

92. The binding defined by claim 91 wherein said posterior end of said horizontal arm has a notch therein, wherein said notch defines two lateral wings at each transverse end thereof, wherein each wing has an opening therein adapted to receive said transverse axis pin, and wherein said lateral wings form a cap for said axis pin.

93. The binding defined by claim 62 further comprising a support on said ski, and a body, integral with said maintenance element to form an assembly pivotable around said support, and wherein said elastic mechanism is part of said assembly, and wherein said linkage means increases the tension of said elastic mechanism when said inertial control mechanism is in said operating position.

94. The binding defined by claim 93 wherein said assembly further comprises an adjustment cap for adjusting the tension of said elastic mechanism and having an opening therein, and wherein said adjustment cap comprises an auxiliary piston slidingly mounted therein and wherein said linkage means comprises a shaft having a posterior end engaging said locking means, and an anterior end having a substantially hemispherically shaped head integral therewith and engaging said adjustment cap, wherein said shaft extends through said opening in said adjustment cap, and wherein said auxiliary piston is biased against a diametral surface of said substantially hemispherically shaped head by said elastic means.

95. The binding defined by claim 63 further comprising a support on said ski; a body, integral with said maintenance element to form an assembly pivotable around said support; and an additional elastic mechanism coupled to said linkage means, wherein the bias of said elastic mechanism is added to the bias of said additional elastic mechanism to bias said maintenance element against release of said boot when said inertial control mechanism is in said operating position.

96. The binding defined by claim 95 wherein said assembly further comprises an adjustment cap for adjusting the tension of said elastic mechanism and wherein said adjustment cap comprises a transverse wall and a bottom portion, together defining a chamber, wherein said adjustment cap further comprises an opening therein; a substantially hemispherically shaped seat adjacent said opening; and wherein said additional elastic mechanism and an auxiliary piston are disposed in said chamber, and wherein said linkage means further comprises a shaft having a posterior end engaging said locking means and an anterior end having a substantially hemispherically shaped head integral therewith and rotatingly mounted in said seat of said adjustment cap, wherein said shaft extends through said opening and said additional elastic biases said auxiliary piston against a diametral surface of said head.

97. The binding defined by claim 63 wherein said abutment is unattached to said linkage means when said inertial control mechanism is in said rest position.

98. The binding defined by claim 97 wherein said linkage mechanism is attached to said maintenance element and wherein a portion of said inertial control mechanism contacts said linkage means when said inertial control mechanism is in said operating position.

99. The binding defined by claim 98 further comprising an addition elastic mechanism for biasing said abutment against movement with said maintenance element when said inertial control mechanism is in said operating position.

100. The binding defined by claim 99 wherein said binding further comprises a support, attached to said ski, and a body integral with said maintenance element to form a pivotable assembly pivotable about said support against the bias of said elastic mechanism, wherein said elastic mechanism is part of said pivotable assembly.

101. The binding defined by claim 100 wherein said linkage means is attached to said assembly and said abutment is adapted to be pivoted, wherein said additional elastic mechanism biases said abutment against pivoting with said assembly when said inertial control mechanism is in said operating position.

102. The binding defined by claim 101 wherein said linkage means comprises an arm attached to said body of said binding and wherein said abutment further coprises:

(i) a base attached to said ski; and (ii) a disk rotatably mounted on said base having a seat thereon; and wherein said inertial control mechanism comprises:

(i) a ball bearing supported by said seat; and (ii) a lever journalled around a transverse axis, having an anterior arm biased into contact with said ball bearing when said inertial control mechanism is in said rest position, and a posterior arm, spaced from said arm of said linkage means when said inertial control mechanism is in said rest position.

103. The binding defined by claim 102 wherein said lever pivots so that said posterior arm contacts said arm of said linking means when said inertial control means is in said operating position.

104. The binding defined by claim 103 wherein said disk is substantially horizontal and is adapted to pivot around a substantially vertical axis, and wherein said disk has an upper surface in which said seat is disposed.

105. The binding defined by claim 104 wherein said abutment further comprises a spring, disposed between said lever and said disk for biasing said anterior arm against said ball bearing when said inertial control mechanism is in said rest position, and wherein said lever has a transverse opening therein and said disk further comprises a platform having a transverse opening therein, and a transverse axis pin adapted to engage said transverse opening in said lever and said platform.

106. The binding defined by claim 105 wherein said arm of said linkage means has an end comprising a notch and wherein said posterior arm comprises at least one tooth adapted to engage said notch when said inertial control mechanism is in said operating position.

107. The binding defined by claim 105 wherein said arm of said linkage means has an end comprising a tooth and wherein said posterior arm comprises at least one notch adapted to engage said tooth when said inertial control mechanism is in said operating position.

108. The binding defined by claim 102 wherein said disk further comprises a groove thereon, and wherein said abutment comprises a projection biased to engage said groove when said inertial control mechanism is in said rest position.

109. The binding defined by claim 108 wherein said groove is positioned in the longitudinal plane of symmetry of said binding when said inertial control mechanism is in said rest position, and wherein said seat is positioned on the opposite side of said disk from said linkage means.

110. The binding defined by claim 109 wherein said disk further includes a substantially vertical peripheral rib having said seat therein, and wherein said abutment is attached to said ski and further comprises a spring adapted to bias said projection toward said notch.

111. The binding defined by claim 63 wherein said maintenance element comprises:

(i) two independent lateral retention wings each adapted to be journalled around a separate axis, wherein said elastic mechanism biases said wings against journalling around said axes, and wherein said abutment comprises an additional elastic mechanism for additionally biasing said wings against journalling only when said inertial control mechanism is in said operating position.

112. The binding defined by claim 111 wherein said elastic mechanism comprises a rod, contacting said wings, and a primary spring, wherein said primary spring biases said rod against said wings so as to bias said wings against journalling, and wherein said abutment comprises an element slidingly mounted on said ski, and a secondary spring attached between said rod and said sliding element, and wherein said inertial control mechanism comprises a lever adapted to engage said sliding element to prevent sliding movement thereof when said inertial control mechanism is in said operating position.

113. The binding defined by claim 112 wherein said wings are spaced apart and wherein said rod extends between said wing and wherein elastic mechanism further comprises:

(i) a head at the posterior end of said rod;

(ii) a support, on said rod spaced a sufficient distance from said head so that said head contacts one side of said wings and said support contacts the other side of said wings, wherein said primary spring biases said support against said other side of said wings in said rest position; and (iii) a plate attached to the anterior end of said rod, wherein said secondary spring contacts said plate.

114. The binding defined by claim 113 wherein said binding further comprises a base extending from said wings to said element, wherein said sliding element is adapted to slide on said base, and wherein said inertial control mechanism further comprises a support, a ball bearing on said support, wherein said lever has a posterior end is adapted to engage said element when said inertial control mechanism is in said operating position, and an anterior end adapted to engage said ball bearing when said inertial control mechanism is in said rest position, wherein said lever is adapted to be spaced from said sliding element when said inertial control mechanism is in said rest position.

115. The binding defined by claim 63 wherein said abutment increases said release threshold only when said inertial control mechanism is in said operating position.

116. A binding for holding a boot on a ski, comprising:

(a) a maintenance element adapted to releasably hold said boot on said ski in a rest position;

(b) an elastic mechanism adapted to bias said maintenance element into said rest position, wherein said elastic mechanism defines a release threshold, above which said maintenance element releases said boot;

(c) an auxiliary mechanical abutment adapted to be attached to said ski, comprising an inertial control mechanism adapted to occupy a rest position and an operating position, wherein said abutment increases said release threshold when said inertial control mechanism is in said operating position; and (d) linkage means linking said abutment with said maintenance element when said inertial control means is in said operating position, wherein said linkage means varies the tension of said elastic mechanism when said inertial control means is in said operating position.

* * * * *

UNITED STATES PATENT AND TRADEMARK OFFICE

CERTIFICATE OF CORRECTION

PATENT NO. : 4,684,147

DATED : August 4, 1987

INVENTOR(S) : Roger PASCAL et al.

It is certified that error appears in the above-identified patent and that said Letters Patent is hereby corrected as shown below:

At column 6, line 11 change "a" after "has" to ---an---.

At column 7, line 35 change "bose" to ---base ---.

At column 7, line 38 change "bass" to ---ball ---.

At column 8, line 7 change "peripherial" to ---peripheral---.

At column 8, line 14 change "the bias" to --- The bias---.

At column 8, line 17 change "jornalling" to --- journalling---.

At column 8, line 56 change "realeasably" to ---releasably---.

At column 12, line 19 change "12bof" to ---12b of---.

At column 12, line 53 change "26 b" to ---26b ---.

At column 12, line 57 insert ---can--- after "which".

At column 13, line 37 change "manner is" to ---manner in ---.

At column 13, line 39 change "interior" to --- anterior---.

At column 15, line 11 change "intensily" to ---intensity----.

At column 18, line 9 change "disks" to ---disk ---.

UNITED STATES PATENT AND TRADEMARK OFFICE

CERTIFICATE OF CORRECTION

PATENT NO. : 4,684,147

DATED : August 4, 1987

INVENTOR(S) : Roger PASCAL et al.

It is certified that error appears in the above-identified patent and that said Letters Patent is hereby corrected as shown below:

At column 21, line 39 change "in" after "collar" to ---is ---.

At column 23, line 53 change "posteriior" to ---posterior ---.

At column 25, line 17 change "internal" to --- inertial---.

Signed and Sealed this

Fourth Day of October, 1988

*Attest:*

DONALD J. QUIGG

*Attesting Officer*

*Commissioner of Patents and Trademarks*